US011555462B2

(12) United States Patent
Matsushima et al.

(10) Patent No.: US 11,555,462 B2
(45) Date of Patent: Jan. 17, 2023

(54) CONTROLLER AND CONTROL METHOD FOR INTERNAL COMBUSTION ENGINE

(71) Applicant: Mitsubishi Electric Corporation, Tokyo (JP)

(72) Inventors: Yuhei Matsushima, Tokyo (JP); Tatsuhiko Takahashi, Hyogo (JP); Junichi Inoue, Tokyo (JP); Toshikatsu Saito, Tokyo (JP); Kazuhiro Tokuyama, Tokyo (JP); Kazuyo Kako, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/673,210

(22) Filed: Feb. 16, 2022

(65) Prior Publication Data

US 2022/0333544 A1 Oct. 20, 2022

(30) Foreign Application Priority Data

Apr. 16, 2021 (JP) ..... JP2021-069487

(51) Int. Cl.
*F02D 41/14* (2006.01)
*F02D 41/24* (2006.01)
(Continued)

(52) U.S. Cl.
CPC ..... *F02D 41/1401* (2013.01); *F02D 35/024* (2013.01); *F02D 41/009* (2013.01);
(Continued)

(58) Field of Classification Search
CPC ..... F02D 35/02; F02D 35/024; F02D 41/14; F02D 41/1401; F02D 41/00;
(Continued)

(56) References Cited

U.S. PATENT DOCUMENTS 7,958,779 B2 * 6/2011 Nagano ..... G01P 3/489 73/114.25
2017/0292466 A1 * 10/2017 Hagari ..... F02D 41/009
(Continued)

FOREIGN PATENT DOCUMENTS

JP 6029726 B1 11/2016

*Primary Examiner* — John Kwon
*Assistant Examiner* — Johnny H Hoang
(74) *Attorney, Agent, or Firm* — Sughrue Mion, PLLC; Richard C. Turner

(57) ABSTRACT

To provide a controller and a control method for internal combustion engine which can calculate the shaft torque in unburning with good accuracy in all the operating condition in which calculation is required, using the shaft torque in unburning which was set in the specific operating condition, and can improve estimation accuracy of the parameter relevant to the combustion state. A controller for internal combustion engine calculates a specific shaft torque in unburning with reference to a specific unburning condition data; calculates specific and current generated torques of unburning assumption using the physical model equation; calculates a current shaft torque in unburning based on the specific shaft torque in unburning, and the specific and current generated torques of unburning assumption; and calculates an increment of gas pressure torque by burning based on the current shaft torque in unburning and the actual shaft torque in burning condition.

16 Claims, 8 Drawing Sheets

(51) Int. Cl.
*F02D 35/02* (2006.01)
*F02D 41/00* (2006.01)

(52) U.S. Cl.
CPC ..... *F02D 41/0052* (2013.01); *F02D 41/2416* (2013.01); *F02D 41/2451* (2013.01); *F02D 2041/1432* (2013.01); *F02D 2041/1433* (2013.01); *F02D 2200/101* (2013.01); *F02D 2200/1004* (2013.01)

(58) Field of Classification Search
CPC .... F02D 41/0052; F02D 41/009; F02D 41/24; F02D 41/2416; F02D 41/2451; F02D 2200/1004; F02D 2200/101; F02D 2041/1432; F02D 2041/1433; G01M 15/04
See application file for complete search history.

(56) References Cited

U.S. PATENT DOCUMENTS

2018/0087459 A1* 3/2018 Hagari ..... F02D 35/023
2019/0264624 A1* 8/2019 Hagari ..... F02D 35/028

* cited by examiner

FIG. 8

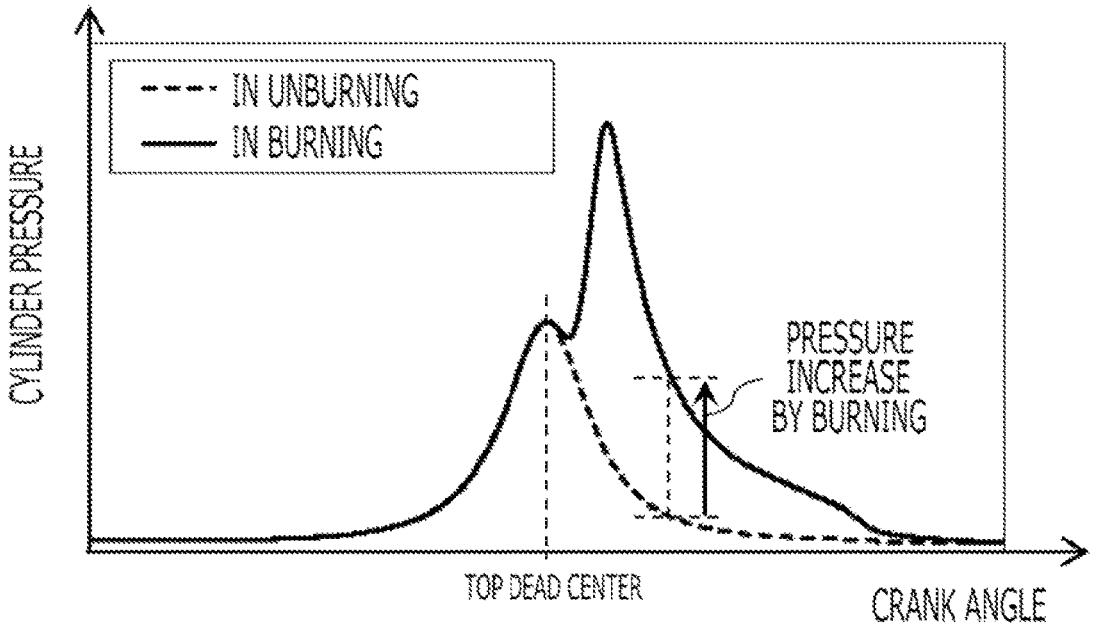

FIG. 9

| SPECIFIC UNBURNING CONDITION DATA OF ω_sp=500 [rpm], Pin_sp=○○ [Pa] | | | | | | | | | |
|---|---|---|---|---|---|---|---|---|---|
| θd | ··· | −4 | 0 | 4 | ··· | 176 | 180 | 184 | ··· |
| Tcrk_mot_sp | ··· | ○○ | ○○ | ○○ | ··· | ○○ | ○○ | ○○ | ··· |

| SPECIFIC UNBURNING CONDITION DATA OF ω_sp=1000 [rpm], Pin_sp=○○ [Pa] | | | | | | | | | |
|---|---|---|---|---|---|---|---|---|---|
| θd | ··· | −4 | 0 | 4 | ··· | 176 | 180 | 184 | ··· |
| Tcrk_mot_sp | ··· | ○○ | ○○ | ○○ | ··· | ○○ | ○○ | ○○ | ··· |

| SPECIFIC UNBURNING CONDITION DATA OF ω_sp=1500 [rpm], Pin_sp=○○ [Pa] | | | | | | | | | |
|---|---|---|---|---|---|---|---|---|---|
| θd | ··· | −4 | 0 | 4 | ··· | 176 | 180 | 184 | ··· |
| Tcrk_mot_sp | ··· | ○○ | ○○ | ○○ | ··· | ○○ | ○○ | ○○ | ··· |

| SPECIFIC UNBURNING CONDITION DATA OF ω_sp=2000 [rpm], Pin_sp=○○ [Pa] | | | | | | | | | |
|---|---|---|---|---|---|---|---|---|---|
| θd | ··· | −4 | 0 | 4 | ··· | 176 | 180 | 184 | ··· |
| Tcrk_mot_sp | ··· | ○○ | ○○ | ○○ | ··· | ○○ | ○○ | ○○ | ··· |

SETTING DATA

*

*

*

CONTROLLER AND CONTROL METHOD FOR INTERNAL COMBUSTION ENGINE

INCORPORATION BY REFERENCE

The disclosure of Japanese Patent Application No. 2021-069487 filed on Apr. 16, 2021 including its specification, claims and drawings, is incorporated herein by reference in its entirety.

BACKGROUND

The present disclosure relates to a controller and a control method for internal combustion engine.

In order to improve the fuel consumption performance and the emission performance of the internal combustion engine, the method of measuring the combustion state of the internal combustion engine and carrying out feedback control of the measuring result is effective. For that purpose, it is important to measure the combustion state of the internal combustion engine accurately. It is known widely that the combustion state of the internal combustion engine can be measured accurately by measuring a cylinder pressure. As the measurement method of cylinder pressure, besides the method of measuring directly based on the cylinder pressure sensor signal, there is the method of estimating the gas pressure torque based on the information on each mechanism of the internal combustion engine, such as the crank angle signal.

As the conventional technology, for example, JP 6029726 B discloses the combustion state estimation apparatus which estimates the combustion state based on the output signal of the crank angle sensor. In the combustion state estimation apparatus disclosed in JP 6029726 B, as shown in the equation (15) of JP 6029726 B, the cylinder internal pressure of the burning cylinder (the left side of equation (15)) is estimated, using the shaft torque calculated based on the crank angle speed and the inertia (the first term of the numerator of the right side of equation (15)), the gas pressure torque by the plurality of unburning cylinders calculated based on the cylinder internal pressure of each unburning cylinder estimated by the pressure in the intake pipe and the like (the second term of the numerator of the right side of equation (15)), the reciprocation inertia torque by the reciprocating movement of piston of each cylinder calculated based on the crank angle speed (the third term of the numerator of the right side of equation (15)), and the external load torque applied to the crankshaft from the outside of the internal combustion engine (the fourth term of the numerator of the right side of equation (15)).

SUMMARY

However, since there is the modeling error in the generated torque of unburning assumption calculated by the physical model equation of the crank mechanism, calculation accuracy of the pressure in cylinder in burning is deteriorated due to the modeling error. For example, as the modeling error, there are influence of the balance weight of the crankshaft and deviation of the center of gravity, and the like which cannot be expressed by the equation (15) of JP 6029726 B. And, in the crank angle, the detection error due to the manufacture error of the tooth of the signal plate, the aging change, and the like is included. The high frequency error component is superimposed on the crank angle acceleration calculated based on the crank angle. In the equation (15) of JP 6029726 B, the pressure in cylinder in burning is calculated, by subtracting the generated torque of unburning assumption which is calculated by the physical model equation of the crank mechanism and on which the high frequency error component is not superimposed (the second term and third term of a numerator of a right side of an equation (15)), from the actual shaft torque calculated based on the crank angle acceleration on which the high frequency error component is superimposed (the first term of the numerator of the right side of equation (15)). Accordingly, the high frequency error component is superimposed on the pressure in cylinder in burning.

The inventors are developing a controller and a control method for internal combustion engine which can suppress deterioration in the estimation accuracy of the parameters relevant to the combustion state, even if the high frequency error component is superimposed on the crank angle acceleration and the modeling of the crank mechanism is not easy. In order to reduce influence of the modeling error, the inventors are developing a method of using the shaft torque which is calculated based on the detection value of the crank angle acceleration if it is unburning condition in the current operating condition (referred to as shaft torque in unburning), in addition to the actual shaft torque calculated based on the crank angle acceleration in the current operating condition. The shaft torque in unburning may be measured and stored in all the operating conditions. However, in the practical operation, the internal combustion engine becomes unburning condition only in a specific operating condition when the fuel cut and the like is performed.

Accordingly, in order to measure and store the shaft torque in unburning in all the operating conditions, the special basic experiment is required. In production of the internal combustion engine, it is difficult to perform the basic experiment about each internal combustion engine from a viewpoint of productive efficiency. On the other hand, even in the practical operation or the production of the internal combustion engine, it is practically possible to measure and store the shaft torque in unburning in the specific operating condition, such as execution time of the fuel cut.

Then, the purpose of the present disclosure is to provide a controller and a control method for internal combustion engine which can calculate the shaft torque in unburning with good accuracy in all the operating conditions in which calculation is required, using the shaft torque in unburning which was set in the specific operating condition, and can improve estimation accuracy of the parameter relevant to the combustion state.

A controller for internal combustion engine according to the present disclosure, including:

an angle information detection unit that detects a crank angle, a crank angle speed, and a crank angle acceleration, based on an output signal of a crank angle sensor;

an actual shaft torque calculation unit that calculates an actual shaft torque applied to a crankshaft, based on a detection value of the crank angle acceleration, and an inertia moment of a crankshaft system, at each crank angle of arithmetic object; and a gas pressure torque calculation unit that, by referring to a specific unburning condition data in which a relationship between a crank angle and a shaft torque in unburning of a specific operating condition is set, calculates the shaft torque in unburning of the specific operating condition corresponding to each crank angle of arithmetic object;

calculates a generated torque of unburning assumption of the specific operating condition which is a torque generated by a gas pressure in cylinder and a reciprocating movement of piston when assuming that it is the specific operating condition and it is unburning, using a physical model equation of a crank mechanism, at each crank angle of arithmetic object;

calculates a generated torque of unburning assumption of a current operating condition which is a torque generated by the gas pressure in cylinder and the reciprocating movement of piston when assuming that it is unburning in the current operating condition, using the physical model equation of the crank mechanism, at each crank angle of arithmetic object;

calculates a shaft torque in unburning of the current operating condition, by correcting the generated torque of unburning assumption of the current operating condition based on the shaft torque in unburning of the specific operating condition, and the generated torque of unburning assumption of the specific operating condition, at each crank angle of arithmetic object;

calculates an external load torque which is a torque applied to the crankshaft from an outside of the internal combustion engine, based on the shaft torque in unburning and the actual shaft torque of the current operating condition which were calculated at a crank angle in a vicinity of a top dead center of a combustion stroke; and calculates an increment of gas pressure torque by burning which is included in a gas pressure torque generated by the gas pressure in cylinder, based on the shaft torque in unburning of the current operating condition, the actual shaft torque in burning, and the external load torque, at each crank angle of arithmetic object.

A control method for internal combustion engine according to the present disclosure, including:

an angle information detection step that detects a crank angle, a crank angle speed, and a crank angle acceleration, based on an output signal of a crank angle sensor;

an actual shaft torque calculation step that calculates an actual shaft torque applied to a crankshaft, based on a detection value of the crank angle acceleration, and an inertia moment of a crankshaft system, at each crank angle of arithmetic object; and a gas pressure torque calculation step that, by referring to a specific unburning condition data in which a relationship between a crank angle and a shaft torque in unburning of a specific operating condition is set, calculates the shaft torque in unburning of the specific operating condition corresponding to each crank angle of arithmetic object;

calculates a generated torque of unburning assumption of the specific operating condition which is a torque generated by a gas pressure in cylinder and a reciprocating movement of piston when assuming that it is the specific operating condition and it is unburning, using a physical model equation of a crank mechanism, at each crank angle of arithmetic object;

calculates a generated torque of unburning assumption of a current operating condition which is a torque generated by the gas pressure in cylinder and the reciprocating movement of piston when assuming that it is unburning in a current operating condition, using the physical model equation of the crank mechanism, at each crank angle of arithmetic object;

calculates a shaft torque in unburning of the current operating condition, by correcting the generated torque of unburning assumption of the current operating condition based on the shaft torque in unburning of the specific operating condition, and the generated torque of unburning assumption of the specific operating condition, at each crank angle of arithmetic object;

calculates an external load torque which is a torque applied to the crankshaft from an outside of the internal combustion engine, based on the shaft torque in unburning and the actual shaft torque of the current operating condition which were calculated at a crank angle in a vicinity of a top dead center of a combustion stroke; and calculates an increment of gas pressure torque by burning which is included in a gas pressure torque generated by the gas pressure in cylinder, based on the shaft torque in unburning of the current operating condition, the actual shaft torque in burning, and the external load torque, at each crank angle of arithmetic object.

Due to a modeling error, a manufacture error of the tooth of the signal plate, and the like, the generated torque of unburning assumption of the current operating condition deviates from the shaft torque (the shaft torque in unburning of the current operating condition) which is assumed to be calculated based on the detection value of the crank angle speed when it is unburning condition in the current operating condition. According to the controller and the control method for internal combustion engine concerning the present disclosure, based on the generated torque of unburning assumption of the specific operating condition and the shaft torque in unburning of the specific operating condition, the deviation of the generated torque of unburning assumption of the specific operating condition with respect to the shaft torque in unburning of the specific operating condition, which occurred due to the modeling error, the manufacture error of the tooth of signal plate, and the like, can be grasped. And, the deviation which occurred due to the modeling error, the manufacture error of the tooth of signal plate, and the like is reflected on the generated torque of unburning assumption of the current operating condition. The shaft torque in unburning of the current operating condition can be calculated with good accuracy in all the operating condition in which calculation is required. Accordingly, in the calculated shaft torque in unburning of the current operating condition, the deviation due to the modeling error is compensated, and similar to the actual shaft torque, the high frequency error component which occurs due to the manufacture error of the tooth of the signal plate and the like is superimposed.

For calculation of the increment of gas pressure torque by burning, the actual shaft torque in burning and the shaft torque in unburning are used. Accordingly, since the physical model equation of the crank mechanism is not used directly like the equation (15) of JP 6029726 B, the modeling error can be reduced. And, in the equation (15) of JP 6029726 B, since the generated torque of unburning assumption on which the high frequency error component is not superimposed is subtracted from the actual shaft torque in burning on which the high frequency error component is superimposed, a high frequency error component is superimposed on the calculated pressure in cylinder in burning. On the other hand, according to the configuration of present disclosure, the high frequency error component included in the actual shaft torque in burning and the high frequency error component included in the shaft torque in unburning can be canceled with each other. The high frequency error component can be reduced from the increment of gas pressure torque by burning. Therefore, even if the high frequency error component is included in the detection value of the crank angle acceleration and the modeling of the crank mechanism is not easy, the estimation accuracy of parameter relevant to the combustion state can be improved.

BRIEF DESCRIPTION OF THE DRAWINGS

FIG. 8 is a figure for explaining the gas pressure in cylinder in unburning and the gas pressure in cylinder in burning according to Embodiment 1;

FIG. 9 is a figure for explaining the specific unburning condition data according to Embodiment 1.

DETAILED DESCRIPTION OF THE EMBODIMENTS

1. Embodiment 1

Figure 1:
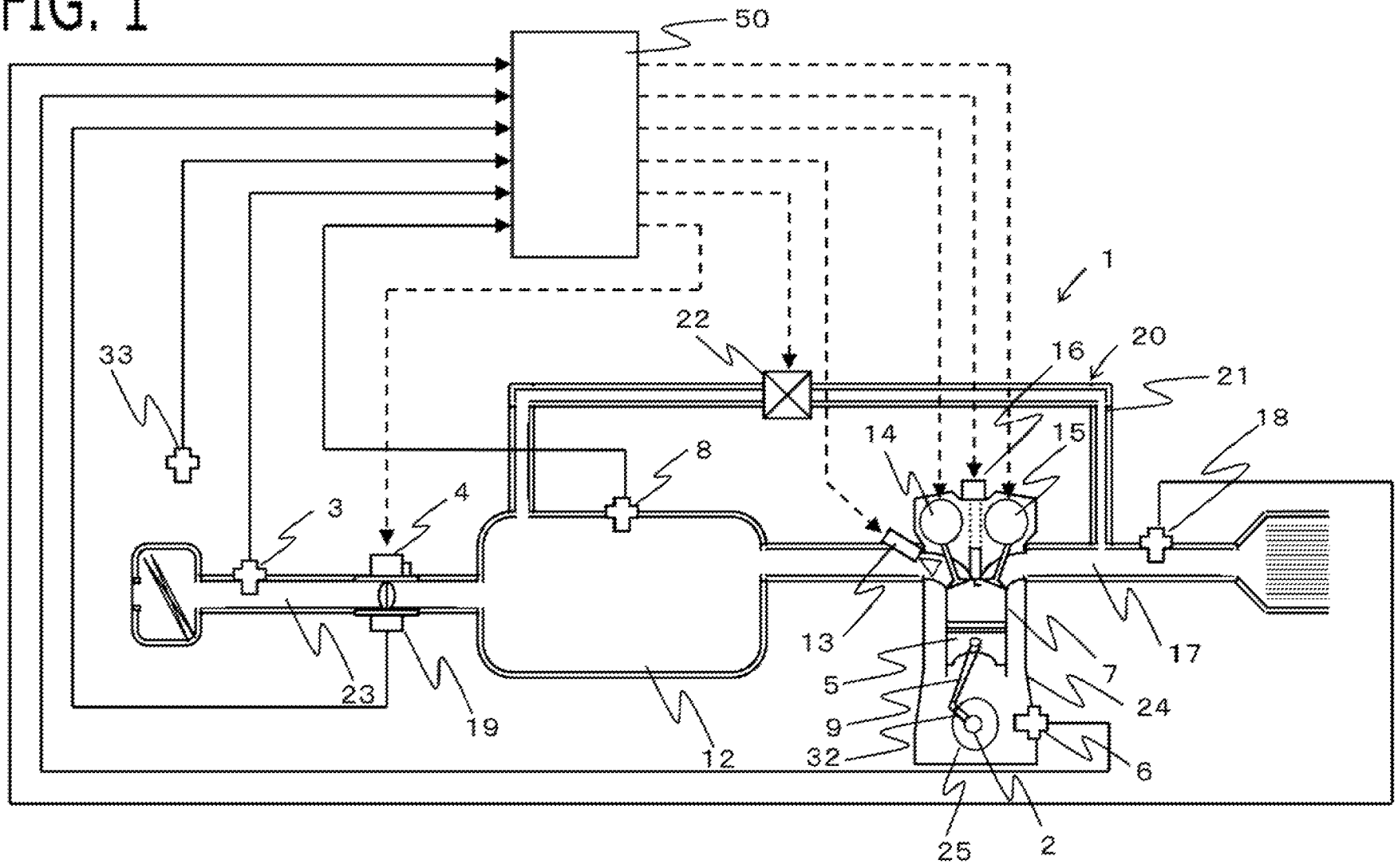
FIG. 1 is a schematic configuration diagram of the internal combustion engine and the controller according to Embodiment 1.
Figure 2:
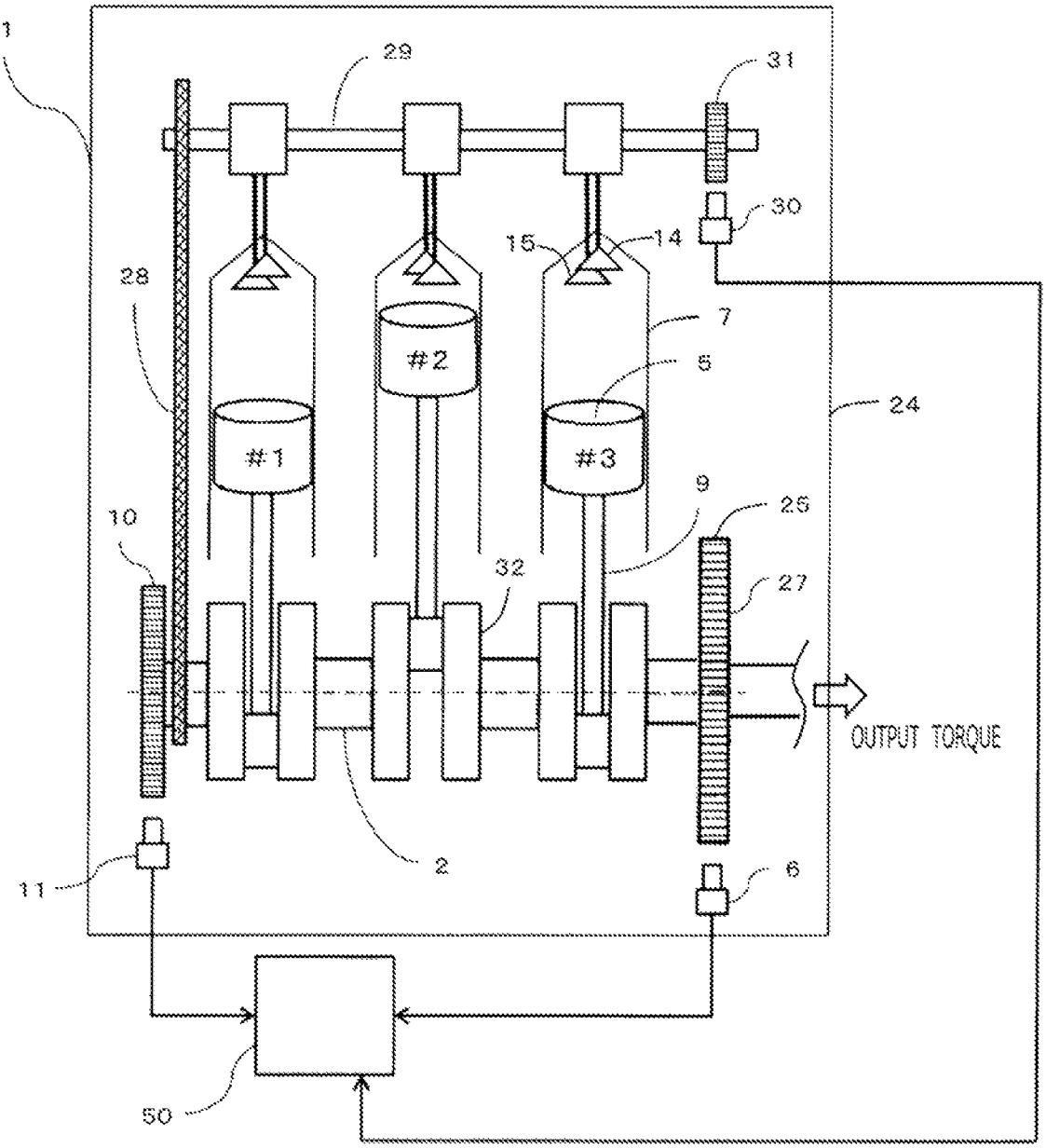
FIG. 2 is a schematic configuration diagram of the internal combustion engine and the controller according to Embodiment 1.
Figure 3:
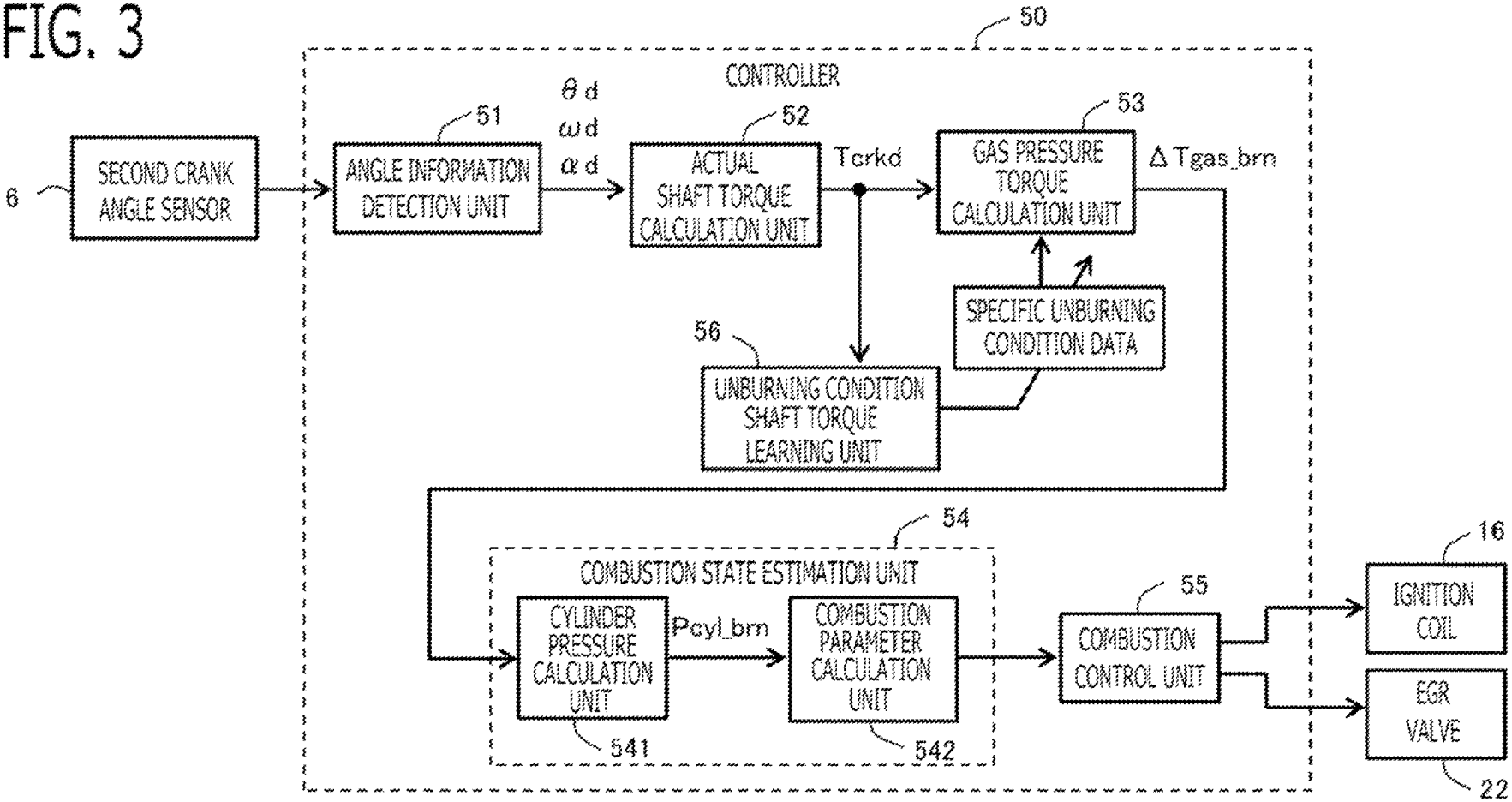
FIG. 3 is a block diagram of the controller according to Embodiment 1.

A controller 50 for internal combustion engine (hereinafter, referred to simply as the controller 50) according to Embodiment 1 will be explained with reference to the drawings. FIG. 1 and FIG. 2 are a schematic configuration diagram of the internal combustion engine 1 and the controller 50; FIG. 3 is a block diagram of the controller 50 according to Embodiment 1. The internal combustion engine 1 and the controller 50 are mounted in a vehicle, and the internal combustion engine 1 functions as a driving-force source for the vehicle (wheels).

1-1. Configuration of Internal Combustion Engine 1

The configuration of the internal combustion engine 1 will be explained. As shown in FIG. 1, the internal combustion engine 1 is provided with cylinders 7 in which a fuel-air mixture is combusted. The internal combustion engine 1 is provided with an intake path 23 for supplying air to the cylinders 7 and an exhaust path 17 for discharging exhaust gas from the cylinders 7. The internal combustion engine 1 is a gasoline engine. The internal combustion engine 1 is provided with a throttle valve 4 which opens and closes intake path 23. The throttle valve 4 is an electronically controlled throttle valve which is opening/closing-driven by an electric motor controlled by controller 50. A throttle position sensor 19 which outputs an electric signal according to the opening degree of the throttle valve 4 is provided in the throttle valve 4.

An air flow sensor 3 which outputs an electric signal according to an intake air amount taken into the intake path 23 is provided in the intake path 23 on the upstream side of throttle valve 4. The internal combustion engine 1 is provided with an exhaust gas recirculation apparatus 20. The exhaust gas recirculation apparatus 20 has an EGR passage 21 which recirculates the exhaust gas from the exhaust path 17 to the intake manifold 12, and an EGR valve 22 which opens and closes the EGR passage 21. The intake manifold 12 is a part of the intake path 23 on the downstream side of the throttle valve 4. The EGR valve 22 is an electronic controlled EGR valve which is opening/closing-driven by an electric motor controlled by controller 50. An air-fuel ratio sensor 18 which outputs an electric signal according to an air-fuel ratio of exhaust gas in the exhaust path 17 is provided in the exhaust path 17.

A manifold pressure sensor 8 which outputs an electric signal according to a pressure in the intake manifold 12 is provided in the intake manifold 12. An injector 13 for injecting a fuel is provided on the downstream side part of the intake manifold 12. The injector 13 may be provided so as to inject a fuel directly into the cylinder 7. An atmospheric pressure sensor 33 which outputs an electric signal according to an atmospheric pressure is provided in the internal combustion engine 1.

An ignition plug for igniting a fuel-air mixture and an ignition coil 16 for supplying ignition energy to the ignition plug are provided on the top of the cylinder 7. An intake valve 14 for adjusting the amount of intake air to be taken from the intake path 23 into the cylinder 7 and an exhaust valve 15 for adjusting the amount of exhaust gas to be exhausted from the cylinder to the exhaust path 17 are provided on the top of the cylinder 7. The intake valve 14 is provided with an intake variable valve timing mechanism which makes the opening and closing timing thereof variable. The exhaust valve 15 is provided with an exhaust variable valve timing mechanism which makes the opening and closing timing thereof variable. Each of the variable valve timing mechanisms 14, 15 has an electric actuator.

As shown in FIG. 2, the internal combustion engine 1 has a plurality of cylinders 7 (in this example, three). A piston 5 is provided inside of the each cylinder 7. The piston 5 of each cylinder 7 is connected to a crankshaft 2 via a connecting rod 9 and a crank 32. The crankshaft 2 is rotated by reciprocating movement of the piston 5. A combustion gas pressure generated in each cylinder 7 presses the top face of the piston 5, and rotates the crankshaft 2 via the connecting rod 9 and the crank 32. The crankshaft 2 is connected with a power transfer mechanism which transmits driving force to the wheels. The power transfer mechanism is provided with a gearbox, a differential gear, and the like. The vehicle provided with the internal combustion engine 1 may be a hybrid vehicle provided with a motor generator in the power transfer mechanism.

The internal combustion engine 1 is provided with a signal plate 10 which rotates integrally with the crankshaft 2. A plurality of teeth are provided in the signal plate 10 at a plurality of preliminarily set crank angles. In the present embodiment, the teeth of the signal plate 10 are arranged at intervals of 10 degrees. The teeth of the signal plate 10 are provided with a chipped tooth part in which a part of teeth is chipped. The internal combustion engine 1 is provided with a first crank angle sensor 11 which is fixed to an engine block 24 and detects the tooth of the signal plate 10.

The internal combustion engine 1 is provided with a cam shaft 29 connected with crankshaft 2 via a chain 28. The cam shaft 29 carries out the opening-and-closing drive of the intake valve 14 and the exhaust valve 15. During the crankshaft 2 rotates two times, the cam shaft 29 rotates once. The internal combustion engine 1 is provided with a signal plate 31 for cam which rotates integrally with the cam shaft 29. A plurality of teeth are provided in the signal plate 31 for cam at a plurality of preliminarily set cam shaft angles. The internal combustion engine 1 is provided with a cam angle sensor 30 which is fixed to an engine block 24 and detects the tooth of signal plate 31 for cam.

Based on two kinds of output signals of the first crank angle sensor 11 and the cam angle sensor 30, the controller 50 detects the crank angle on the basis of the top dead center of each piston 5 and determines the stroke of each cylinder 7. The internal combustion engine 1 is a 4-stroke engine which has an intake stroke, a compression stroke, a combustion stroke, and an exhaust stroke.

The internal combustion engine 1 is provided with a flywheel 27 which rotates integrally with the crankshaft 2. The peripheral part of flywheel 27 is a ring gear 25, and a plurality of teeth are provided in the ring gear 25 at a plurality of preliminarily set crank angles. The teeth of the ring gear 25 are arranged in the peripheral direction with equiangular intervals. In this example, 90 teeth are provided with intervals of 4 degrees. The teeth of ring gear 25 are not provided with a chipped tooth part. The internal combustion engine 1 is provided with a second crank angle sensor 6 which is fixed to the engine block 24 and detects the tooth of the ring gear 25. The second crank angle sensor 6 is disposed oppositely to the ring gear 25 with a space in radial-direction outside of the ring gear 25. The opposite side of the flywheel 27 to the crankshaft 2 is connected with a power transfer mechanism. Accordingly, the output torque of the internal combustion engine 1 passes through a part of the flywheel 27, and is transmitted to the wheels side.

Each of the first crank angle sensor 11, the cam angle sensor 30, and the second crank angle sensor 6 outputs an electric signal according to change of the distance between each sensor and tooth by rotation of the crankshaft 2. The output signal of each angle sensor 11, 30, 6 becomes a rectangular wave that a signal turns on or off when the distance between sensor and tooth is near or when the distance is far. An electromagnetic pickup type sensor is used for each angle sensor 11, 30, 6, for example.

Since the flywheel 27 (the ring gear 25) has larger number of teeth than the number of teeth of the signal plate 10, and there is also no chipped tooth part, a high resolution angle detection can be expected. Since the flywheel 27 has larger mass than the mass of the signal plate 10 and high frequency oscillation is suppressed, a high accuracy of angle detection can be expected.

1-2. Configuration of Controller 50

Figure 4:
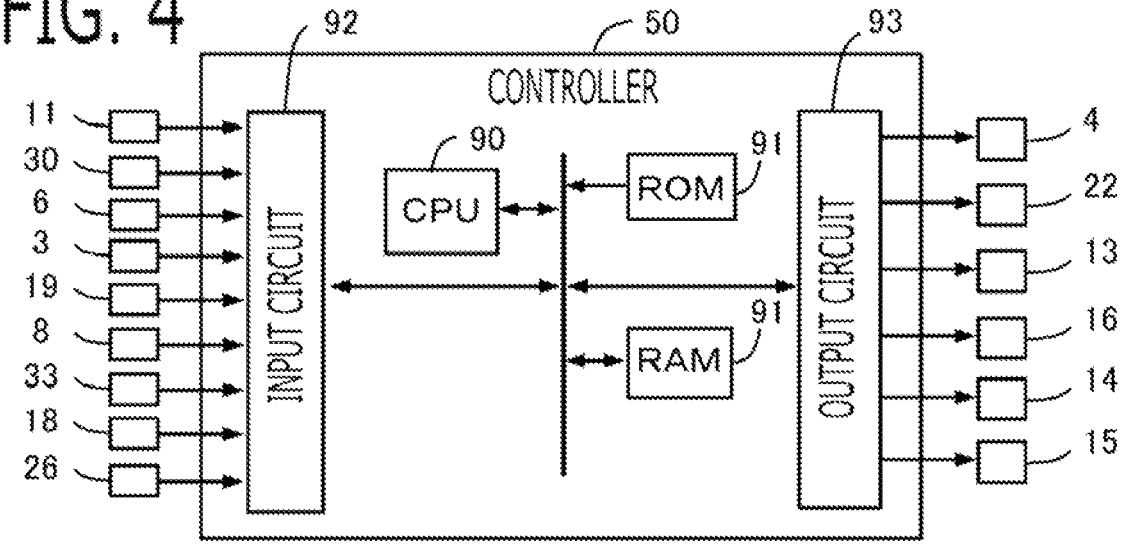
FIG. 4 is a hardware configuration diagram of the controller according to Embodiment 1.

Next, the controller 50 will be explained. The controller 50 is the one whose control object is the internal combustion engine 1. As shown in FIG. 3, the controller 50 is provided with control units such as an angle information detection unit 51, an actual shaft torque calculation unit 52, a gas pressure torque calculation unit 53, a combustion state estimation unit 54, a combustion control unit 55, and an unburning condition shaft torque learning unit 56. The respective control units 51 to 56 of the controller 50 are realized by processing circuits included in the controller 50. Specifically, as shown in FIG. 4, the controller 50 includes, as a processing circuit, an arithmetic processor (computer) 90 such as a CPU (Central Processing Unit), storage apparatuses 91 which exchange data with the arithmetic processor 90, an input circuit 92 which inputs external signals to the arithmetic processor 90, an output circuit 93 which outputs signals from the arithmetic processor 90 to the outside, and the like.

As the arithmetic processor 90, ASIC (Application Specific Integrated Circuit), IC (Integrated Circuit), DSP (Digital Signal Processor), FPGA (Field Programmable Gate Array), various kinds of logical circuits, various kinds of signal processing circuits, and the like may be provided. As the arithmetic processor 90, a plurality of the same type ones or the different type ones may be provided, and each processing may be shared and executed.

As the storage apparatus 91, volatile and nonvolatile storage apparatuses, such as RAM (Random Access Memory), ROM (Read Only Memory), and EEPROM (Electrically Erasable Programmable ROM), are provided. The input circuit 92 is connected with various kinds of sensors and switches and is provided with an A/D converter and the like for inputting output signals from the sensors and the switches to the arithmetic processor 90. The output circuit 93 is connected with electric loads and is provided with a driving circuit and the like for outputting a control signal from the arithmetic processor 90.

In addition, the computing processing unit 90 runs software items (programs) stored in the storage apparatus 91 such as ROM and EEPROM, and collaborates with other hardware devices in the controller 50, such as the storage apparatus 91, the input circuit 92, and the output circuit 93, so that the respective functions of the control units 51 to 56 included in the controller 50 are realized. Setting data items, such as the polytropic index Nply, the cylinder volume Vcyl0 at valve closing of the intake valve, the projection area Sp of the top face of the piston, the crank length r, the connecting rod length L, the mass mp of the piston, the specific unburning condition data, the inertia moment Icrk, and the filter coefficient bj, to be utilized in the control units 51 to 56 are stored, as part of software items (programs), in the storage apparatus 91 such as ROM and EEPROM. Each calculation value and each detection value, such as the crank angle θd, the crank angle speed cod, the crank angle acceleration ad, the actual shaft torque Tcrkd, the shaft torque in unburning of the specific operating condition Tcrk_mot_sp, the generated torque of unburning assumption of the specific operating condition Tcal_mot_sp, the generated torque of unburning assumption of the current operating condition Tcal_mot, the shaft torque in unburning of the current operating condition Tcrk_mot, the increment of gas pressure torque by burning ΔTgas_brn, and the gas pressure in cylinder in burning Pcyl_brn, which are calculated by each control unit 51 to 56, are stored in the storage apparatus 91, such as RAM.

In the present embodiment, the input circuit 92 is connected with the first crank angle sensor 11, the cam angle sensor 30, the second crank angle sensor 6, the air flow sensor 3, the throttle position sensor 19, the manifold pressure sensor 8, the atmospheric pressure sensor 33, the air fuel ratio sensor 18, an accelerator position sensor 26, and the like. The output circuit 93 is connected with the throttle valve 4 (electric motor), the EGR valve 22 (electric motor), the injector 13, the ignition coil 16, the intake-air variable valve timing mechanism 14, the exhaust-gas variable valve timing mechanism 15, and the like. The controller 50 is connected with various kinds of unillustrated sensors, switches, actuators, and the like. The controller 50 detects operating conditions of the internal combustion engine 1, such as an intake air amount, a pressure in the intake manifold, an atmospheric pressure, an air-fuel ratio, and an accelerator opening degree, based on the output signals of various sensors.

As basic control, the controller 50 calculates a fuel injection amount, an ignition timing, and the like, based on inputted output signals and the like from the various kinds of sensors, and then performs driving control of the injector 13, the ignition coil 16, and the like. Based on the output signal of the accelerator position sensor 26 and the like, the controller 50 calculates an output torque of the internal combustion engine 1 demanded by the driver, and then controls the throttle valve 4 and the like so that an intake air amount for realizing the demanded output torque is obtained. Specifically, the controller 50 calculates a target throttle opening degree and then performs driving control of the electric motor of the throttle valve 4 so that the throttle opening degree which is detected based on the output signal of the throttle position sensor 19 approaches the target throttle opening degree. And, the controller 50 calculates a target opening degree of the EGR valve 22 based on inputted output signals and the like from the various kinds of sensors and then performs driving control of the electric motor of the EGR valve 22. The controller 50 calculates a target opening and closing timing of the intake valve and a target opening and closing timing of the exhaust valve based on the output signals of the various sensors, and performs driving control of the intake and the exhaust variable valve timing mechanisms 14, 15 based on each target opening and closing timing.

1-2-1. Angle Information Detection Unit 51

The angle information detection unit 51 detects a crank angle θd, a crank angle speed cod which is a time change rate of the crank angle θd, and a crank angle acceleration ad which is a time change rate of the crank angle speed cod, based on the output signal of the second crank angle sensor 6.

Figure 5:
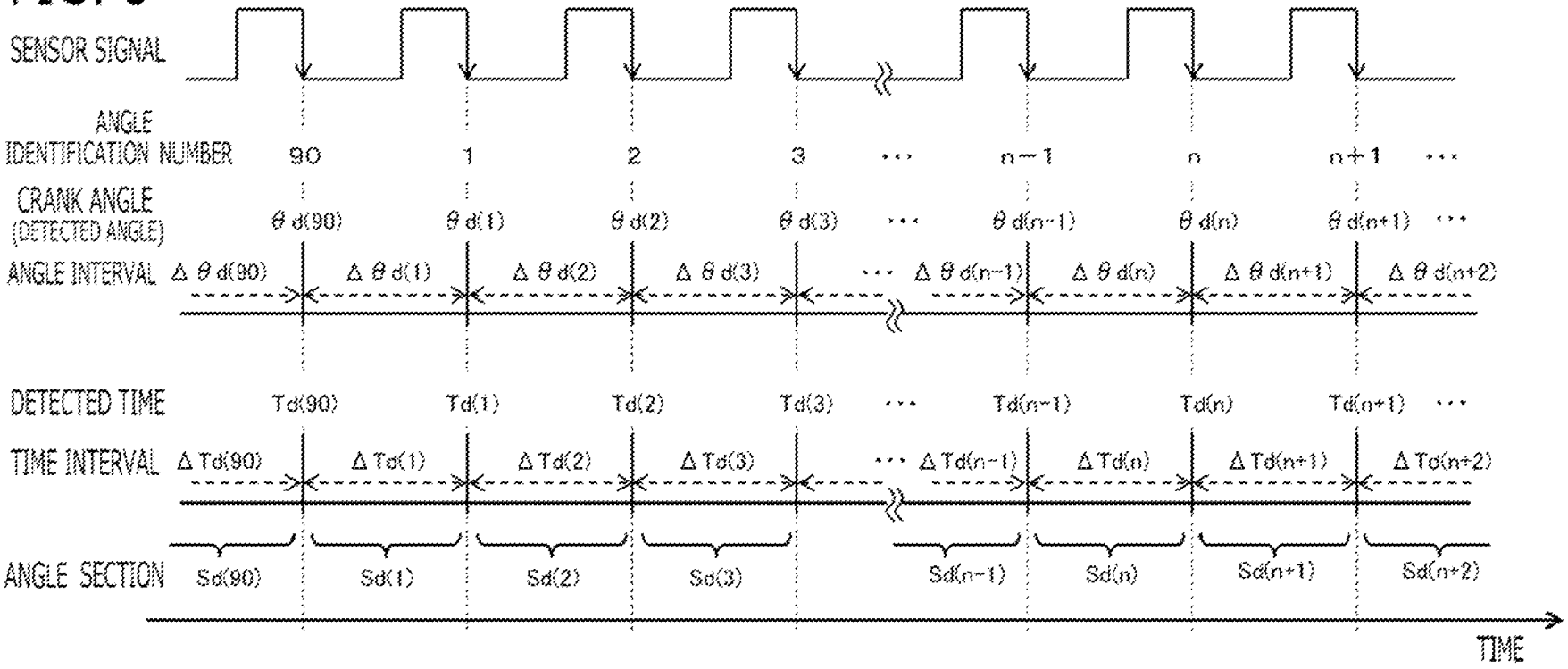
FIG. 5 is a time chart for explaining an angle information detection processing according to Embodiment 1.

In the present embodiment, as shown in FIG. 5, the angle information detection unit 51 detects the crank angle θd based on the output signal of the second crank angle sensor 6 and detects a detected time Td at which the crank angle θd is detected. Then, based on a detected angle θd which is the detected crank angle θd, and the detected time Td, the angle information detection unit 51 calculates an angle interval ΔθD and a time interval ΔTd corresponding to an angle section Sd between the detected angles θd.

In the present embodiment, the angle information detection unit 51 determines the crank angle θd when a falling edge (or rising edge) of the output signal (rectangular wave) of the second crank angle sensor 6 is detected. The angle information detection unit 51 determines a basing point falling edge which is a falling edge corresponding to a basing point angle (for example, 0 degree which is a top dead center of the piston 5 of the first cylinder #1), and determines the crank angle θd corresponding to a number n of the falling edge which is counted up on the basis of the basing point falling edge (hereinafter, referred to as an angle identification number n). For example, when the basing point falling edge is detected, the angle information detection unit 51 sets the crank angle θd to the basing point angle (for example, 0 degree), and sets the angle identification number n to 1. Then, every time the falling edge is detected, the angle information detection unit 51 increases the crank angle θd by a preliminarily set angle interval ΔθD (in this example, 4 degrees) and increases the angle identification number n by one. Alternatively, the angle information detection unit 51 may read out the crank angle θd corresponding to the this time identification number n, by use of an angle table in which a relationship between the angle identification number n and the crank angle θd is preliminarily set. The angle information detection unit 51 correlates the crank angle θd (the detected angle θd) with the angle identification number n. The angle identification number n returns to 1 after a maximum number (in this example, 90). The last time angle identification number n of the angle identification number n=1 is 90, and the next time angle identification number n of the angle identification number n=90 is 1.

In the present embodiment, as described later, the angle information detection unit 51 determines the basing point falling edge of the second crank angle sensor 6 with reference to a reference crank angle detected based on the first crank angle sensor 11 and the cam angle sensor 30. For example, the angle information detection unit 51 determines the falling edge at which the reference crank angle when the falling edge of the second crank angle sensor 6 is detected becomes the closest to the basing point angle, as the basing point falling edge.

The angle information detection unit 51 determines the stroke of each cylinder 7 corresponding to the crank angle θd with reference to the stroke of each cylinder 7 determined based on the first crank angle sensor 11 and the cam angle sensor 30.

The angle information detection unit 51 detects a detected time Td when the falling edge of the output signal (rectangular wave) of the second crank angle sensor 6 is detected, and correlates the detected time Td with the angle identification number n. Specifically, the angle information detection unit 51 detects the detected time Td using the timer function provided in the arithmetic processor 90.

As shown in FIG. 5, when the falling edge is detected, the angle information detection unit 51 sets the angle section between the detected angle θd(n) corresponding to the this time angle identification number (n) and the detected angle θd(n−1) corresponding to the last time angle identification number (n−1), as the angle section Sd(n) corresponding to the this time angle identification number (n).

As shown in an equation (1), when the falling edge is detected, the angle information detection unit 51 calculates a deviation between the detected angle θd(n) corresponding to the this time angle identification number (n) and the detected angle θd(n−1) corresponding to the last time angle identification number (n−1), and sets the calculated deviation as the angle interval ΔθD(n) corresponding to the this time angle identification number (n) (the this time angle section Sd(n)).

$$\Delta\theta d(n)=\theta d(n)-\theta d(n-1) \tag{1}$$

In the present embodiment, since all the angle intervals of the tooth of ring gear 25 are made equal, the angle information detection unit 51 sets the angle interval ΔθD of all the angle identification numbers n as a preliminarily set angle (in this example, 4 degrees).

As shown in an equation (2), when the falling edge is detected, the angle information detection unit 51 calculates a deviation between the detected time Td(n) corresponding to the this time angle identification number (n) and the detected time Td(n−1) corresponding to the last time angle identification number (n−1), and sets the calculated deviation as the time interval ΔTd(n) corresponding to the this time angle identification number (n) (the this time angle section Sd(n)).

$$\Delta Td(n)=Td(n)-Td(n-1) \tag{2}$$

Based on two kinds of output signals of the first crank angle sensor 11 and the cam angle sensor 30, the angle information detection unit 51 detects the reference crank angle on the basis of the top dead center of the piston 5 of the first cylinder #1, and determines the stroke of each cylinder 7. For example, the angle information detection unit 51 determines the falling edge just after the chipped tooth part of the signal plate 10 based on the time interval of the falling edge of the output signal (rectangular wave) of the first crank angle sensor 11. Then, the angle information detection unit 51 determines a correspondency between the each falling edge on the basis of the falling edge just after the chipped tooth part, and the reference crank angle on the basis of the top dead center, and calculates the reference crank angle on the basis of the top dead center when each falling edge is detected. The angle information detection unit 51 determines the stroke of each cylinder 7 based on the relationship between the position of the chipped tooth part in the output signal (rectangular wave) of the first crank angle sensor 11, and the output signal (rectangular wave) of the cam angle sensor 30.

<Filter Processing>

Figure 6:
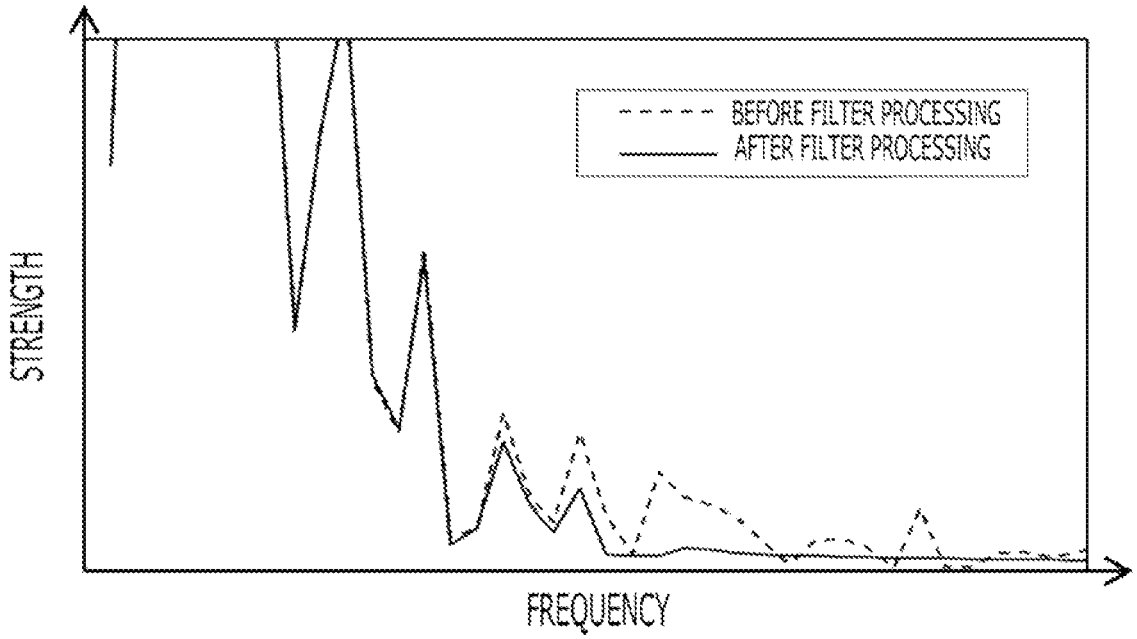
FIG. 6 is a figure showing a frequency spectrum of the crank angle periods before and after filter according to Embodiment 1.

The angle information detection unit 51 performs a filter processing which removes a high frequency error component, when calculating the crank angle acceleration ad. The angle information detection unit 51 performs the filter processing to the time interval ΔTd. The time interval ΔTd is a crank angle period ΔTd which is a period of a unit angle (in this example, 4 degrees). As the filter processing, for example, a finite impulse response (FIR) filter is used. As FIG. 6 shows a frequency spectrum of the time interval (the crank angle period) before and after filter, the high frequency component caused by the production variation of teeth and the like is reduced by the filter processing. As described later, even if the high frequency component of the increment of gas pressure torque by burning ΔTgas_brn cannot be removed by subtracting the shaft torque in unburning Tcrk_mot from the actual shaft torque in burning Tcrkd_brn calculated based on the crank angle acceleration ad, the high frequency component of the increment of gas pressure torque by burning ΔTgas_brn can be reduced by reducing the high frequency component of the crank angle acceleration ad by the filter processing.

For example, as the FIR filter, the processing shown in the equation (3) is performed.

$$\Delta Tdf(n) = \sum_{j=0}^{N} b_j \Delta Td(n-j) \tag{3}$$

Herein, ΔTdf(n) is a time interval (a crank angle period) after filter, N is an order of the filter, and bj is a coefficient of the filter.

The angle information detection unit 51 performs the filter processing with the same filter characteristics between the unburning condition and the burning condition. In this example, the order N of the filter and the each coefficient of the filter are set to the same values between the unburning condition and the burning condition. According to this configuration, when the specific unburning condition data are updated by the actual shaft torque in unburning described below, the removal state of the high frequency error component of the actual shaft torque in unburning and the removal state of the high frequency error component of the actual shaft torque in burning can be matched. Accordingly, the unremoved high frequency error component can be canceled by subtracting the shaft torque in unburning Tcrk_mot from the actual shaft torque in burning Tcrkd_brn when calculating the increment of gas pressure torque by burning ΔTgas_brn, and the calculation accuracy of the increment of gas pressure torque by burning ΔTgas_brn can be suppressed from deteriorating by the high frequency error component.

The filter processing which removes the high frequency error component may be performed to the crank angle speed ωd(n) described below, instead of the time interval ΔTd. Alternatively, the filter processing may not be performed when calculating the crank angle acceleration ad.

Instead of the filter processing or with the filter processing, the angle information detection unit 51 may correct the time interval ΔTd(n) of each angle identification number n by a correction coefficient Kc(n) which is set corresponding to each angle identification number n. The correction coefficients Kc(n) are learned based on the time intervals ΔTd(n) using the method disclosed in JP 6169214 B and the like, or are preliminarily set by matching in production.

<Calculation of Crank Angle Speed ωd and Crank Angle Acceleration αd>

Based on the angle interval Δθd and the time interval after filter ΔTdf, the angle information detection unit 51 calculates a crank angle speed ωd which is a time change rate of the crank angle θd, and a crank angle acceleration ad which is a time change rate of the crank angle speed ωd, corresponding to each of the detected angle θd or the angle interval Sd.

Figure 7:
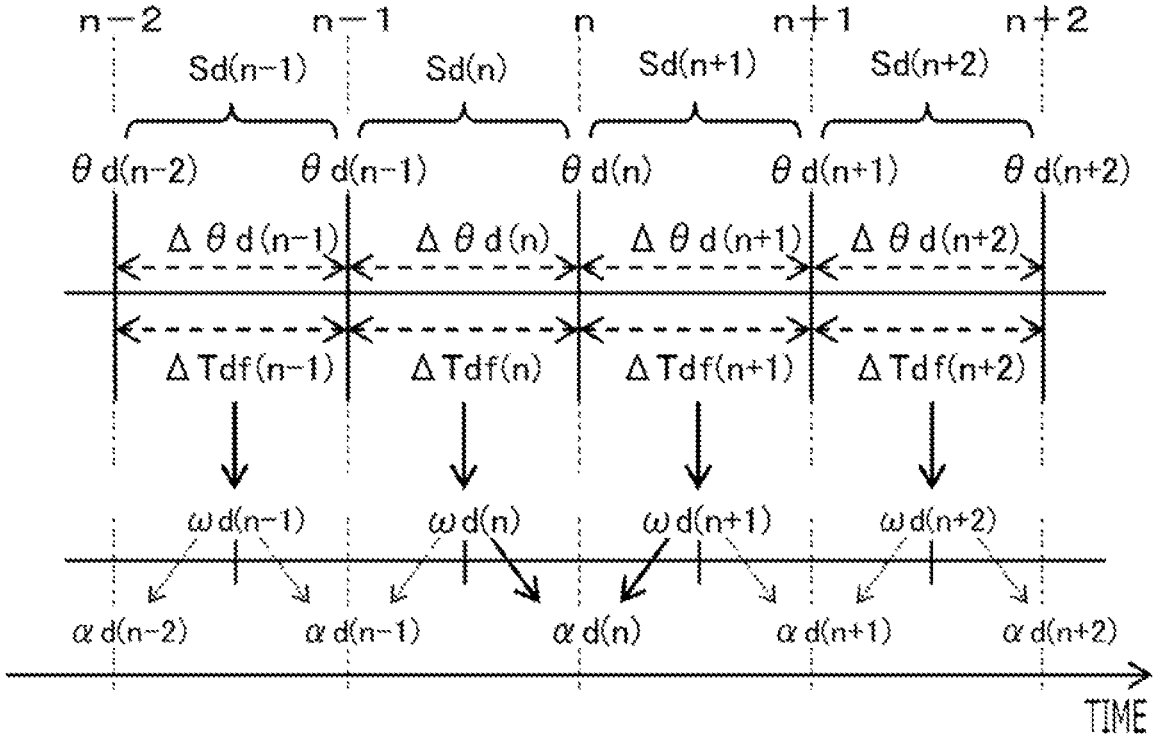
FIG. 7 is a time chart for explaining an angle information calculation processing according to Embodiment 1.

In the present embodiment, as shown in FIG. 7, based on the angle interval Δθd(n) and the time interval ΔTdf(n) corresponding to the angle interval Sd(n) set to the processing object, the angle information detection unit 51 calculates the crank angle speed ωd(n) corresponding to the angle interval Sd(n) of the processing object. Specifically, as shown in the equation (4), the angle information detection unit 51 calculates the crank angle speed ωd(n) by dividing the angle interval Δθd(n) corresponding to the angle interval Sd(n) of the processing object by the time interval after filter ΔTdf(n).

$$\omega d(n) = \frac{\Delta\theta d(n)}{\Delta Tdf(n)} \times \frac{\pi}{180} \tag{4}$$

Based on the crank angle speed ωd(n) and the time interval after filter ΔTdf(n) corresponding to the just before one angle interval Sd(n) of the detected angle θd(n) set to the processing object, and the crank angle speed ωd(n+1) and the time interval after filter ΔTdf(n+1) corresponding to the just after one angle interval Sd(n+1) of the detected angle θd(n) set to the processing object, the angle information detection unit 51 calculates the crank angle acceleration ad(n) corresponding to the detected angle θd(n) of the processing object. Specifically, as shown in the equation (5), the angle information detection unit 51 calculates the crank angle acceleration ad(n) by dividing a subtraction value obtained by subtracting the just before crank angle speed ωd(n) from the just after crank angle speed ωd(n+1), by an average value of the just after time interval after filter ΔTdf(n+1) and the just before time interval after filter ΔTdf(n).

$$\alpha d(n) = \frac{\omega d(n+1) - \omega d(n)}{\Delta Tdf(n+1) + \Delta Tdf(n\}} \times 2 \tag{5}$$

The angle information detection unit 51 stores angle information, such as the angle identification number n, the crank angle θd(n), the time interval before filter ΔTd(n), the time interval after filter ΔTdf (n), the crank angle speed ωd(n), and the crank angle acceleration ad(n), to the storage apparatus 91 such as RAM, during a period at least longer than the combustion stroke.

1-2-2. Actual Shaft Torque Calculation Unit 52

The actual shaft torque calculation unit 52 calculates an actual shaft torque Tcrkd applied to the crankshaft, based on the detection value of crank angle acceleration ad, and an inertia moment Icrk of the crankshaft system, at each crank angle of arithmetic object θd_obj.

Each crank angle of arithmetic object θd_obj is set to each crank angle within a crank angle range of arithmetic object which is set corresponding to the burning period.

In the present embodiment, as shown in the next equation, the actual shaft torque calculation unit 52 calculates the actual shaft torque Tcrkd(n) by multiplying the inertia moment Icrk of the crankshaft system to the detection value of crank angle acceleration ad(n), at each crank angle θd_obj(n).

$$Tcrkd(n)=\alpha d(n)\times Icrk \quad (6)$$

The inertia moment Icrk of the crankshaft system is an inertia moment of the whole member which rotates integrally with the crankshaft 2 (for example, the crankshaft 2, the crank 32, the flywheel 27, and the like), and is preliminarily set.

The actual shaft torque calculation unit 52 stores the calculated actual shaft torque Tcrkd(n) to the storage apparatus 91 such as RAM, together with angle information such as corresponding the angle identification number n and the crank angle θd(n), during a period at least longer than the combustion stroke.

1-2-3. Gas Pressure Torque Calculation Unit 53

1-2-3-1. Calculation of Shaft Torque in Unburning of Current Operating Condition <Calculation Principle of Shaft Torque in Unburning of Current Operating Condition>

As described later, for calculation of the increment of gas pressure torque by burning ΔTgas_brn, in all the operating conditions in which calculation is required, the shaft torque (referred to as the shaft torque in unburning of the current operating condition) which is assumed to be calculated based on the detection value of the crank angle speed ωd when it is unburning in the current operating condition is required. But, in the practical operation, the internal combustion engine becomes unburning condition only in a specific operating condition when the fuel cut and the like is performed. Accordingly, in order to measure and store the shaft torque in unburning in all the operating conditions, the special basic experiment is required. In production of the internal combustion engine, it is difficult to perform the basic experiment about each internal combustion engine from a viewpoint of productive efficiency. On the other hand, even in the practical operation or the production of the internal combustion engine, it is practically possible to measure and store the shaft torque in unburning in the specific operating condition, such as execution time of the fuel cut.

On the other hand, if a physical model equation of the crank mechanism is used, a generated torque when assuming that it is unburning in the current operating condition can be calculated in all the operating conditions in which calculation is required. If there is no error, the generated torque calculated by the physical model equation and the shaft torque should coincide. However, due to a modeling error, a manufacture error of the tooth of the signal plate, and the like, a deviation between the shaft torque in unburning of the current operating condition and the generated torque calculated by the physical model equation occurs. Then, in the present disclosure, as explained in the following, based on the shaft torque in unburning measured in the specific operating condition, and the generated torque calculated using the physical model equation in the specific operating condition, the deviation which occurred due to the modeling error, the manufacture error of the tooth of the signal plate, and the like is grasped. And, by reflecting the grasped deviation to the generated torque which calculated using the physical model equation in the current operating condition, the shaft torque in unburning of the current operating condition is calculated with good accuracy in all the operating conditions in which calculation is required.

<Calculation of Shaft Torque in Unburning of Specific Operating Condition Tcrk_mot_sp>

By referring to a specific unburning condition data in which a relationship between the crank angle θd and a shaft torque in unburning of the specific operating condition Tcrk_mot_sp is set, the gas pressure torque calculation unit 53 calculates the shaft torque in unburning of the specific operating condition Tcrk_mot_sp corresponding to each crank angle of arithmetic object θd_obj.

In the present embodiment, the specific crank angle speed co sp and the specific condition of the intake gas amount in cylinder are included in the specific operating condition. The specific condition of the intake gas amount in cylinder is set to a condition of the intake gas amount in cylinder whose frequency is higher than a fixed value when the internal combustion engine is unburning condition. For example, the specific condition of the intake gas amount in cylinder is set to a condition of the intake gas amount in cylinder in which the fuel cut is performed. The fuel cut is performed when the throttle valve is closed. Accordingly, the specific condition of the intake gas amount in cylinder may be set to a condition of the intake gas amount in cylinder when the throttle valve is closed and the fuel cut is performed. Alternatively, in the case of the hybrid vehicle, in the unburning condition, the internal combustion engine is rotated by the motor, and it can set to any crank angle speed and any condition of intake gas amount in cylinder. Accordingly, the specific condition of the intake gas amount in cylinder may be set to a condition of the intake gas amount in cylinder which is easily realized.

A plurality of specific crank angle speeds ω_sp are provided. The plurality of specific crank angle speeds ω_sp are set with an interval. If the crank angle speed is converted into [rpm], the plurality of specific crank angle speeds ω_sp are set to 500 [rpm], 1000 [rpm], 1500 [rpm], 2000 [rpm], and . . . , for example. The specific condition of the intake gas amount in cylinder is set to a condition of the intake gas amount in cylinder in which the fuel cut is performed. At each of the plurality of specific crank angle speeds co sp, the specific condition of the intake gas amount in cylinder is set to the specific condition of the intake gas amount in cylinder in which the fuel cut is performed.

The specific unburning condition data is set for each of the plurality of specific operating conditions. In the present embodiment, as shown in FIG. 9, for each of the plurality of specific crank angle speeds ω_sp, as the specific unburning condition data, a map data in which a relationship between the crank angle θd and the shaft torque in unburning Tcrk_mot_sp of the specific condition of the intake gas amount in cylinder is set is stored in the storage apparatus 91. Instead of the map data, an approximation function, such as a polynomial or a neural network, may be used. In the specific unburning condition data of each specific operating condition, the specific condition of the intake gas amount in cylinder at measurement (in this example, a specific gas pressure in the intake pipe Pin sp) is also stored.

The specific unburning condition data is preliminarily set based on experimental data, and is stored in the storage apparatus 91, such as ROM and EEPROM. In the present embodiment, the specific unburning condition data which is updated based on the actual shaft torque in unburning Tcrkd of the specific operating condition by the unburning condition shaft torque learning unit 56 described below is used.

By referring to the specific unburning condition data of the specific crank angle speed closest to the current detection value of the crank angle speed ωd, the gas pressure torque calculation unit 53 calculates the shaft torque in unburning of the specific operating condition Tcrk_mot_sp corresponding to each crank angle of arithmetic object θd_obj.

Alternatively, by referring to the specific unburning condition data of the first specific crank angle speed closest to the current detection value of the crank angle speed ωd, the gas pressure torque calculation unit 53 may calculate the first shaft torque in unburning of the specific operating condition Tcrk_mot_sp_1 corresponding to each crank angle of arithmetic object θd_obj. And, by referring to the specific unburning condition data of the second specific crank angle speed second closest to the current detection value of the crank angle speed ωd, the gas pressure torque calculation unit 53 may calculate the second shaft torque in unburning of the specific operating condition Tcrk_mot_sp_2 corresponding to each crank angle of arithmetic object θd_obj. Then, at each crank angle of arithmetic object θd_obj, the gas pressure torque calculation unit 53 may calculate the final shaft torque in unburning of the specific operating condition Tcrk_mot_sp, by performing linear interpolation between the first shaft torque in unburning of the specific operating condition Tcrk_mot_sp_1 and the second shaft torque in unburning of the specific operating condition Tcrk_mot_sp_2, based on a ratio of a deviation between the current detection value of the crank angle speed ωd and the first specific crank angle speed, and a deviation between the current detection value of the crank angle speed ωd and the second specific crank angle speed. In this case, the current detection value of the crank angle speed ωd becomes the final specific crank angle speed ω_sp. And, a value obtained by performing linear interpolation, based on the above ratio, between the first specific condition of the intake gas amount in cylinder corresponding to the specific unburning condition data of the first specific crank angle speed and the second specific condition of the intake gas amount in cylinder corresponding to the specific unburning condition data of the second specific crank angle speed becomes the final specific condition of the intake gas amount in cylinder.

<Calculation of Generated Torque of Unburning Assumption of the Specific Operating Condition Tcal_mot_sp>

At each crank angle of arithmetic object θd_obj, using the physical model equation of the crank mechanism, the gas pressure torque calculation unit 53 calculates a generated torque of unburning assumption of the specific operating condition Tcal_mot_sp which is a torque generated by a gas pressure in cylinder and a reciprocating movement of piston when assuming that it is the specific operating condition and it is unburning. Herein, the operating condition at measurement of the calculated shaft torque in unburning of the specific operating condition Tcrk_mot_sp is used for the specific operating condition.

At each crank angle of arithmetic object θd_obj, using a physical model equation which calculates the gas pressure torque generated by the gas pressure in cylinder, the gas pressure torque calculation unit 53 calculates the gas pressure torque Tgas_mot_sp generated by the gas pressure in cylinder Pcyl_mot_sp when assuming that the internal combustion engine is unburning condition, based on the specific condition of the intake gas amount in cylinder.

Using the next equation which calculates the gas pressure by the polytropic change, the gas pressure torque calculation unit 53 calculates the gas pressure in cylinder of unburning assumption Pcyl_mot_sp_i of each cylinder i, based on the specific gas pressure in intake pipe Pin sp which is proportional to the intake gas amount in cylinder as the specific condition of the intake gas amount in cylinder, and the crank angle of arithmetic object θd_obj. Herein, the gas pressure in intake pipe at measurement of the calculated shaft torque in unburning of the specific operating condition Tcrk_mot_sp is used for the specific gas pressure in intake pipe Pin sp, and is stored in association with the specific unburning condition data used for calculation.

$$\text{Pcyl_mot_sp_i} = \left(\frac{Vcyl0}{\text{Vcyl_}\theta\text{_i}}\right)^{Nply} \times \text{Pin_sp} \tag{7}$$

$$\text{Vcyl_}\theta\text{_i} = Vcyl0 - Sp \times r\left\{(1+\cos(\theta\text{d_obj_i})) - \frac{r}{L}(1+\cos(2\times\theta\text{d_obj_i}))\right\}$$

Herein, Nply is a polytropic index, and a preliminarily set value is used. Vcyl0 is the cylinder volume of the combustion cylinder at valve closing of the intake valve. A preliminarily set value may be used for Vcyl0, or Vcyl0 may be changed according to the valve closing timing of the intake valve by the intake variable valve timing mechanism 14 at measurement of the corresponding specific unburning condition data. Vcly_θ_i is the cylinder volume of each cylinder i at the crank angle of arithmetic object θd_obj. Sp is a projection area of the top face of the piston. r is the crank length. L is the length of the connecting rod. As the crank angle of arithmetic object θd_obj_i of each cylinder i used for the calculation of the trigonometric function, the crank angle obtained by shifting the crank angle of arithmetic object θd_obj so that the top dead center of the compression stroke becomes 0 degree about each cylinder i is used.

Instead of the second equation of the equation (7), data (for example, map data, approximation equation, or the like) in which a relationship between the crank angle θd and the cylinder volume Vcly_θ of the combustion cylinder is preliminarily set may be used.

Then, using the next equation which converts the gas pressure into the torque, the gas pressure torque calculation unit 53 calculates the gas pressure torque of unburning assumption of the specific operating condition Tgas_mot_sp, based on the gas pressure in cylinder of unburning assumption Pcyl_mot_sp_i of each cylinder i, and the crank angle of arithmetic object θd_obj_i of each cylinder i.

$$\text{Tgas_mot_sp} = \sum_{j=1}^{N}(\text{Pcyl_mot_sp_i} \times Sp \times \text{R_i}) \tag{8}$$

$$\text{R_i} = r\left\{\sin(\theta\text{d_obj_i}) - \frac{1}{2}\frac{r}{L}\cos(2\times\theta\text{d_obj_i})\right\}$$

Herein, R_i is a conversion coefficient which converts a force generated at the piston of each cylinder i into a torque around the crankshaft. In the case of the offset crank, an offset may be considered in calculation of the conversion coefficient R_i. N is a cylinder number, and N is set to 3 in the present embodiment.

At each crank angle of arithmetic object θd_obj, using the physical model equation which calculates the inertia torque generated by the reciprocating movement of piston, the gas pressure torque calculation unit 53 calculates an inertia torque Tin_sp generated by the reciprocating movement of piston, based on the specific crank angle speed ω_sp included in the specific operating condition. Herein, the crank angle speed at measurement of the calculated shaft torque in unburning of the specific operating condition Tcrk_mot_sp is used for the specific crank angle speed ω_sp, and is stored in association with the specific unburning condition data used for calculation.

Using the next equation which converts the acceleration of piston and the inertial force of piston into torque, the gas pressure torque calculation unit 53 calculates the inertia torque Tin_sp generated by the reciprocating movement of piston of each cylinder i, based on the specific crank angle speed ω_sp and the crank angle of arithmetic object θd_obj.

$$\mathrm{Tin_sp} = \sum_{i=1}^{N} (mp \times \alpha\mathrm{p_sp_i} \times \mathrm{R_i}) \tag{9}$$

$$\alpha\mathrm{p_sp_i} = \omega_\mathrm{sp}^2 \times r\left\{\cos(\theta\mathrm{d_obj_i}) + \frac{r}{L}\cos(2 \times \theta\mathrm{d_obj_i})\right\}$$

Herein, mp is a mass of the piston; αp_sp_i is the acceleration of piston of each cylinder i at the specific crank angle speed ω_sp; and R_i is the conversion coefficient calculated by the second equation of the equation (8). An inertia torque generated by the inertia of the connecting rod and the like may be added to the inertia torque Tin_sp.

Then, at each crank angle of arithmetic object θd_obj, the gas pressure torque calculation unit 53 calculates the generated torque of unburning assumption of the specific operating condition Tcal_mot_sp by totaling the gas pressure torque Tgas_mot_sp and the inertia torque Tin_sp.

$$T\mathrm{cal}_mot_sp = T\mathrm{gas}_mot_sp + T\mathrm{in}_sp \tag{10}$$

<Calculation of Generated Torque of Unburning Assumption of Current Operating Condition Tcal_mot>

At each crank angle of arithmetic object θd_obj, using the physical model equation of the crank mechanism, the gas pressure torque calculation unit 53 calculates the generated torque of unburning assumption of the current operating condition Tcal_mot which is a torque generated by the gas pressure in cylinder and the reciprocating movement of piston when assuming that it is unburning in the current operating condition.

At each crank angle of arithmetic object θd_obj, using the physical model equation which calculates the gas pressure torque generated by the gas pressure in cylinder, the gas pressure torque calculation unit 53 calculates the gas pressure torque Tgas_mot generated by the gas pressure in cylinder Pcyl_mot when assuming that the internal combustion engine is unburning condition, based on the current condition of the intake gas amount in cylinder.

Using the next equation which calculates the gas pressure by the polytropic change, the gas pressure torque calculation unit 53 calculates the gas pressure in cylinder of unburning assumption Pcyl_mot_i of each cylinder i, based on the current gas pressure in intake pipe Pin which is proportional to the intake gas amount in cylinder as the current condition of the intake gas amount in cylinder, and the crank angle of arithmetic object θd_obj.

$$\mathrm{Pcyl_mot_i} = \left(\frac{Vcyl0}{\mathrm{Vcyl_}\theta\mathrm{_i}}\right)^{N_{ply}} \times \mathrm{Pin} \tag{11}$$

$$\mathrm{Vcyl_}\theta\mathrm{_i} = Vcyl0 - Sp \times r\left\{(1 + \cos(\theta\mathrm{d_obj_i})) - \frac{r}{L}(1 + \cos(2 \times \theta\mathrm{d_obj_i}))\right\}$$

As the current gas pressure in intake pipe Pin, the pressure in the intake manifold detected based on the output signal of the manifold pressure sensor 8 is used. The pressure detected near the valve closing timing of the intake valve may be used. But, the pressure detected at other near timing or an average value of the pressure may be used. The current gas pressure in intake pipe Pin may be inversely calculated from the current intake air amount in cylinder or the charging efficiency, EGR rate, and the like.

Then, using the next equation which converts gas pressure into torque, the gas pressure torque calculation unit 53 calculates the gas pressure torque of unburning assumption of the current operating condition Tgas_mot, based on the gas pressure in cylinder of unburning assumption Pcyl_mot_i of each cylinder i, and the crank angle of arithmetic object θd_obj_i of each cylinder i.

$$\mathrm{Tgas_mot_sp} = \sum_{i=1}^{N} (\mathrm{Pcyl_mot_i} \times Sp \times \mathrm{R_i}) \tag{12}$$

$$\mathrm{R_i} = r\left\{\sin(\theta\mathrm{d_obj_i}) - \frac{1}{2}\frac{r}{L}\cos(2 \times \theta\mathrm{d_obj_i})\right\}$$

At each crank angle of arithmetic object θd_obj, the gas pressure torque calculation unit 53 calculates the inertia torque Tin generated by the reciprocating movement of piston, based on the detection value of the crank angle speed ωd.

The gas pressure torque calculation unit 53 calculates the acceleration of piston, and using the next equation which converts the inertial force of piston generated by acceleration into torque, calculates the inertia torque Tin generated by the reciprocating movement of piston of each cylinder i, based on the detection value of the crank angle speed ωd, and the crank angle of arithmetic object θd_obj.

$$Tin = \sum_{i=1}^{N} (mp \times \alpha\mathrm{p_i} \times \mathrm{R_i}) \tag{13}$$

$$\alpha\mathrm{p_i} = \omega d^2 \times r\left\{\cos(\theta\mathrm{d_obj_i}) + \frac{r}{L}\cos(2 \times \theta\mathrm{d_obj_i})\right\}$$

Herein, αp_i is the acceleration of piston of each cylinder i. R_i is the conversion coefficient calculated by the second equation of the equation (12). An inertia torque generated by the inertia of the connecting rod and the like may be added to the inertia torque Tin.

Then, at each crank angle of arithmetic object θd_obj, the gas pressure torque calculation unit 53 calculates the generated torque of unburning assumption of the current operating condition Tcal_mot, by totaling the gas pressure torque Tgas_mot and the inertia torque Tin.

$$T\mathrm{cal}_mot = T\mathrm{gas}_mot + T\mathrm{in} \tag{14}$$

<Calculation of Shaft Torque in Unburning of Current Operating Condition Tcrk_mot>

At each crank angle of arithmetic object θd_obj, the gas pressure torque calculation unit 53 calculates the shaft torque in unburning of the current operating condition Tcrk_mot, by correcting the generated torque of unburning assumption of the current operating condition Tcal_mot based on the shaft torque in unburning of the specific operating condition Tcrk_mot_sp and the generated torque of unburning assumption of the specific operating condition Tcal_mot_sp.

Due to the modeling error, the manufacture error of the tooth of the signal plate, and the like, the generated torque of unburning assumption of the current operating condition Tcal_mot deviates from the shaft torque (the shaft torque in unburning of the current operating condition Tcrk_mot) which is assumed to be calculated based on the detection value of the crank angle speed ωd when it is unburning in the current operating condition. According to the above configuration, based on the shaft torque in unburning of the specific operating condition Tcrk_mot_sp and the generated torque of unburning assumption of the specific operating condition Tcal_mot_sp, the deviation of the generated torque of unburning assumption of the specific operating condition Tcal_mot_sp with respect to the shaft torque in unburning of the specific operating condition Tcrk_mot_sp, which occurred due to the modeling error, the manufacture error of the tooth of signal plate, and the like, can be grasped. And, the deviation which occurred due to the modeling error, the manufacture error of the tooth of signal plate, and the like is reflected on the generated torque of unburning assumption of the current operating condition Tcal_mot. The shaft torque in unburning of the current operating condition Tcrk_mot can be calculated with good accuracy in all the operating conditions in which calculation is required. Accordingly, in the calculated shaft torque in unburning of the current operating condition Tcrk_mot, the deviation due to the modeling error is compensated, and similar to the actual shaft torque Tcrkd, the high frequency error component which occurs due to the manufacture error of the tooth of the signal plate and the like is superimposed. Then, using the shaft torque in unburning of the current operating condition Tcrk_mot calculated with good accuracy, the increment of gas pressure torque by burning ΔTgas_brn described below can be calculated with good accuracy.

In the present embodiment, at each crank angle of arithmetic object θd_obj, as shown in the next equation, the gas pressure torque calculation unit 53 calculates the shaft torque in unburning of the current operating condition Tcrk_mot, by adding a torque difference obtained by subtracting the generated torque of unburning assumption of the specific operating condition Tcal_mot_sp from the shaft torque in unburning of the specific operating condition Tcrk_mot_sp, to the generated torque of unburning assumption of the current operating condition Tcal_mot.

$$Tcrk_mot = Tcal_mot + (Tcrk_mot_sp - T_mot_sp) \tag{15}$$

According to this configuration, the deviation which occurred due to the modeling error, the manufacture error of the tooth of signal plate, and the like can be calculated by the torque difference obtained by subtracting the generated torque of unburning assumption of the specific operating condition Tcal_mot_sp from the shaft torque in unburning of the specific operating condition Tcrk_mot_sp. And, by adding the torque difference to the generated torque of unburning assumption of the current operating condition Tcal_mot, the shaft torque in unburning of the current operating condition Tcrk_mot can be calculated with good accuracy.

Alternatively, at each crank angle of arithmetic object θd_obj, as shown in the next equation, the gas pressure torque calculation unit 53 may calculate the shaft torque in unburning of the current operating condition Tcrk_mot, by multiplying a torque ratio of the shaft torque in unburning of the specific operating condition Tcrk_mot_sp with respect to the generated torque of unburning assumption of the specific operating condition Tcal_mot_sp, to the generated torque of unburning assumption of the current operating condition Tcal_mot.

$$Tcrk_mot = Tcal_mot \times \frac{Tcrk_mot_sp}{Tcal_mot_sp} \tag{16}$$

According to this configuration, the deviation which occurred due to the modeling error, the manufacture error of the tooth of signal plate, and the like can be calculated by the torque ratio of the shaft torque in unburning of the specific operating condition Tcrk_mot_sp with respect to the generated torque Tcal_mot_sp of unburning assumption of constant operating condition. And, by multiplying the torque ratio to the generated torque of unburning assumption of the current operating condition Tcal_mot, the shaft torque in unburning of the current operating condition Tcrk_mot can be calculated with good accuracy.

1-2-3-2. Calculation of External Load Torque in Burning

<Calculation Principle of External Load Torque>

As shown in FIG. 8, the gas pressure in cylinder in burning increases by a pressure increase by burning more than the gas pressure in cylinder in unburning. As shown in the next equation, the shaft torque in burning Tcrk_brn increases by an increment of shaft torque ΔTgas_brn generated by this pressure increment by burning more than the shaft torque in unburning Tcrk_mot. Since this increment of shaft torque ΔTgas_brn is an increment of gas pressure torque generated by the gas pressure increase which is an increase from the gas pressure in cylinder in unburning to the gas pressure in cylinder in burning, it is referred to as an increment of gas pressure torque by burning ΔTgas_brn. The shaft torque in unburning Tcrk_mot includes a gas pressure torque which is a torque applied to the crankshaft by a force of the gas pressure in each cylinder in unburning pushing the piston, and a reciprocation inertia torque which is a torque applied to the crankshaft by a reciprocation inertia of the piston of each cylinder. As described later, since the shaft torque in unburning Tcrk_mot does not include an external load torque in burning Tload_brn, as shown in the next equation, it is necessary to subtract the external load torque in burning Tload_brn. The external load torque Tload is a torque applied to the crankshaft from the outside of the internal combustion engine. The external load torque Tload includes a running resistance and a frictional resistance of the vehicle which are transmitted to the internal combustion engine from the power transfer mechanism connected with the wheels, and an auxiliary machine load, such as the alternator connected with the crankshaft.

$$Tcrk_brn = Tcrk_mot + \Delta Tgas_brn - Tload_brn \tag{17}$$

In the vicinity of the top dead center, the connecting rod and the crank become in a straight line, and the shaft torque Tcrk is not generated by the force of the gas pressure in cylinder pushing the piston. Accordingly, in the vicinity of the top dead center of the compression stroke, the increment of shaft torque by burning ΔTgas_brn becomes 0. Therefore, as shown in the next equation obtained by modifying the equation (17), by subtracting the actual shaft torque in this time burning Tcrkd_brn_tdc in the vicinity of the top dead center from the shaft torque in unburning Tcrk_mot_tdc in the vicinity of the top dead center, the external load torque in this time burning Tload_brn can be calculated.

$$\Delta T\text{gas}_brn_tdc=0$$

$$T\text{load}_brn=T\text{crk}_mot_tdc-T\text{crkd}_brn_tdc \quad (18)$$

Since the external load torque Tload does not fluctuate largely in the stroke period, the external load torque Tload calculated in the vicinity of the top dead center can be used at each crank angle of arithmetic object θd_obj corresponding to the burning period.

In the present disclosure, "burning condition" and "in burning" are a condition and a time that the controller 50 controls so as to burn fuel in the combustion stroke. And, "unburning condition" and "in unburning" are a condition and a time that the controller 50 controls so as not to burn fuel in the combustion stroke.

<Calculation of External Load Torque>

The gas pressure torque calculation unit 53 calculates the external load torque Tload_brn which is a torque applied to the crankshaft from the outside of the internal combustion engine, based on the shaft torque in unburning of the current operating condition Tcrk_mot and the actual shaft torque in burning Tcrkd_brn which were calculated at the crank angle in the vicinity of the top dead center of the combustion stroke. Herein, the vicinity of the top dead center is within an angle interval from 10 degrees before the top dead center to 10 degrees after the top dead center, for example. For example, the crank angle θd_tdc in the vicinity of the top dead center is preliminarily set to the crank angle of the top dead center.

In the present embodiment, as explained using the equation (18), the gas pressure torque calculation unit 53 calculates the external load torque in burning Tload_brn, by subtracting the actual shaft torque in burning Tcrkd_brn_tdc in the vicinity of the top dead center from the shaft torque in unburning of the current operating condition Tcrk_mot_tdc in the vicinity of the top dead center, as shown in the next equation.

$$T\text{load}_brn=T\text{crk}_mot_tdc-T\text{crkd}_brn_tdc \quad (19)$$

1-2-3-3. Calculation of Increment of Gas Pressure Torque by Burning

As shown in the next equation obtained by modifying the equation (17), the increment of gas pressure torque by burning ΔTgas_brn can be calculated by subtracting the shaft torque in unburning Tcrk_mot from the shaft torque in burning Tcrk_brn, and adding the external load torque in burning Tload_brn.

$$\Delta T\text{gas}_brn=T\text{crk}_brn-T\text{crk}_mot+T\text{load}_brn \quad (20)$$

Then, at each crank angle of arithmetic object θd_obj, the gas pressure torque calculation unit 53 calculates the increment of gas pressure torque by burning ΔTgas_brn which is included in the gas pressure torque generated by the gas pressure in cylinder, based on the shaft torque in unburning of the current operating condition Tcrk_mot, the actual shaft torque in burning Tcrkd_brn, and the external load torque Tload_brn.

In the present embodiment, as explained using the equation (20), as shown in the next equation, at each crank angle of arithmetic object θd_obj, the gas pressure torque calculation unit 53 calculates the increment of gas pressure torque by burning ΔTgas_brn, by subtracting the shaft torque in unburning of the current operating condition Tcrk_mot from the actual shaft torque in burning Tcrkd_brn and adding the external load torque Tload_brn.

$$\Delta T\text{gas}_brn=T\text{crkd}_brn-T\text{crk}_mot+T\text{load}_brn$$

As mentioned above, in the shaft torque in unburning of the current operating condition Tcrk_mot, the modeling error is compensated, and similar to the actual shaft torque Tcrkd_brn, the high frequency error component which occurs due to the manufacture error of the tooth of the signal plate and the like is superimposed. According to the above configuration, for calculation of the increment of gas pressure torque by burning ΔTgas_brn, the actual shaft torque in burning Tcrkd_brn and the shaft torque in unburning Tcrk_mot are used. Accordingly, since the physical model equation of the crank mechanism is not used directly like the equation (15) of JP 6029726 B, the modeling error can be reduced. And, in the equation (15) of JP 6029726 B, since the generated torque of unburning assumption on which the high frequency error component is not superimposed is subtracted from the actual shaft torque in burning on which the high frequency error component is superimposed, a high frequency error component is superimposed on the calculated pressure in cylinder in burning. On the other hand, according to the above configuration, the high frequency error component included in the actual shaft torque in burning Tcrkd_brn and the high frequency error component included in the shaft torque in unburning Tcrk_mot can be canceled with each other. And, the high frequency error component can be reduced from the increment of gas pressure torque by burning ΔTgas_brn. Accordingly, even if the high frequency error component is included in the detection value of the crank angle acceleration ad and the modeling of the crank mechanism is not easy, the estimation accuracy of parameter relevant to the combustion state can be improved.

Since the gas pressure torque of the combustion cylinder becomes about 0 in the vicinity of the top dead center of the combustion stroke, the external load torque Tload_brn can be calculated with small arithmetic load, based on the shaft torque in unburning Tcrk_mot_tdc in the vicinity of the top dead center, and the actual shaft torque in burning Tcrkd_brn_tdc in the vicinity of the top dead center. Then, as the parameter relevant to the combustion state, the increment of gas pressure torque by burning ΔTgas_brn can be calculated with small arithmetic load, based on the shaft torque in unburning Tcrk_mot, the actual shaft torque in burning Tcrkd_brn, and the external load torque Tload_brn. Therefore, even if the high frequency error component is included in the detection value of the crank angle acceleration ad and the modeling of the crank mechanism is not easy, the arithmetic load can be reduced while suppressing deterioration in the estimation accuracy of the parameters relevant to the combustion state.

<Setting of Crank Angle of Arithmetic Object>

The gas pressure torque calculation unit 53 sets sequentially each crank angle θd within the crank angle range of arithmetic object which is set corresponding to the burning period, as the crank angle of arithmetic object θd_obj, and performs each calculation processing for calculating the increment of gas pressure torque by burning ΔTgas_brn at each set crank angle θd_obj.

For example, the increment of gas pressure torque by burning ΔTgas_brn of each crank angle may be collectively calculated based on the detection values and the calculation values of each crank angle θd stored in the storage apparatus 91, every time when the combustion stroke of each cylinder is ended, or may be calculated every time when each crank angle θd is detected.

The gas pressure torque calculation unit 53 stores each calculation value, such as the shaft torque in unburning of the specific operating condition Tcrk_mot_sp, the generated torque of unburning assumption of the specific operating condition Tcal_mot_sp, the generated torque of unburning assumption of the current operating condition Tcal_mot, the shaft torque in unburning Tcrk_mot, and the increment of gas pressure torque by burning ΔTgas_brn, which were calculated at each crank angle θd, to the storage apparatus 91 such as RAM, together with angle information such as corresponding the angle identification number n and the crank angle θd, during a period at least longer than the combustion stroke.

<External Load Torque Included in Shaft Torque in Unburning>

As shown in the next equation, if the external load torque in unburning Tload_mot is included in the shaft torque in unburning Tcrk_mot, an error due to the external load torque in unburning Tload_mot is included in the external load torque in burning Tload_brn calculated by the equation (19).

$$Tload_brn=(Tcrk_mot_tdc-Tload_mot)-Tcrkd_brn_tdc \tag{22}$$

However, even in this case, as shown in the next equation, when calculating the increment of gas pressure torque by burning ΔTgas_brn by the equation (21), the error of the external load torque in unburning Tload_mot included in the external load torque in burning Tload_brn is canceled by the external load torque in unburning Tload_mot included in the shaft torque in unburning Tcrk_mot, and the calculation accuracy of the increment of gas pressure torque by burning ΔTgas_brn is not deteriorated. Accordingly, the external load torque in unburning Tload_mot may or may not be included in the shaft torque in unburning Tcrk_mot.

$$\begin{aligned}\Delta Tgas_brn &= Tcrkd_brn-(Tcrk_mot-Tload_mot)+Tload_brn \\ &= Tcrkd_brn-(Tcrk_mot-Tload_mot)+ \\ &\quad (Tcrk_mot_tdc-Tload_mot)-Tcrkd_brn_tdc \\ &= Tcrkd_brn-Tcrk_mot+(Tcrk_mot_tdc-Tcrkd_brn_tdc)\end{aligned} \tag{23}$$

1-2-4. Combustion State Estimation Unit 54

The combustion state estimation unit 54 estimates a combustion state of the internal combustion engine, based on the increment of gas pressure torque by burning ΔTgas_brn.

In the present embodiment, the combustion state estimation unit 54 is provided with a cylinder pressure calculation unit 541 and a combustion parameter calculation unit 542.

1-2-4-1. Cylinder Pressure Calculation Unit 541

<Calculation of Gas Pressure in Cylinder in Unburning>

At each crank angle of arithmetic object θd_obj, the cylinder pressure calculation unit 541 calculates a gas pressure in cylinder in unburning Pcyl_mot at the crank angle of arithmetic object θd_obj when assuming that it is unburning, based on the current condition of the intake gas amount in cylinder (in this example, the current gas pressure in intake pipe Pin). In the present embodiment, the cylinder pressure calculation unit 541 calculates the gas pressure in cylinder in unburning Pcyl_mot using the equation (11) mentioned above. The calculating result of the above equation (11) may be used.

<Calculation of Gas Pressure in Cylinder in Burning>

Then, at each crank angle of arithmetic object θd_obj, the cylinder pressure calculation unit 541 calculates the gas pressure in cylinder in burning Pcyl_brn, based on the gas pressure in cylinder in unburning Pcyl_mot and the increment of gas pressure torque by burning ΔTgas_brn.

In the present embodiment, at each crank angle of arithmetic object θd_obj, the cylinder pressure calculation unit 541 calculates an increment of gas pressure in cylinder by burning ΔPcyl_brn, based on the increment of gas pressure torque by burning ΔTgas_brn. For example, the cylinder pressure calculation unit 541 calculates the increment of gas pressure in cylinder by burning ΔPcyl_brn using the next equation.

$$\Delta Pcyl_brn=\frac{\Delta Tgas_brn}{Sp\times R_brn} \tag{24}$$

$$R_brn=r\left\{\sin(\theta d_obj_brn)-\frac{1}{2}\frac{r}{L}\cos(2\times\theta d_obj_brn)\right\}$$

Herein, R_brn is a conversion coefficient which converts force generated on the piston of the combustion cylinder into torque. As the crank angle of arithmetic object θd_obj_brn of the combustion cylinder, the crank angle obtained by shifting the crank angle of arithmetic object θd_obj so that the top dead center of the compression stroke of the combustion cylinder becomes 0 degree is used.

Then, as shown in the next equation, at each crank angle of arithmetic object θd_obj, the cylinder pressure calculation unit 541 calculates the gas pressure in cylinder in burning Pcyl_brn, by adding the gas pressure in cylinder in unburning Pcyl_mot and the increment of gas pressure in cylinder by burning ΔPcyl_brn.

$$Pcyl_brn=Pcryl_mot+\Delta Pcyl_brn \tag{25}$$

The cylinder pressure calculation unit 541 sets sequentially each crank angle θd within the crank angle range of arithmetic object which is set corresponding to the burning period, as the crank angle of arithmetic object θd_obj, and at each set crank angle θd, performs calculation processing which calculates the gas pressure in cylinder in burning Pcyl_brn.

For example, the gas pressure in cylinder in burning Pcyl_brn of each crank angle may be collectively calculated based on the detection values and the calculation values of each crank angle θd stored in the storage apparatus 91, every time when the combustion stroke of each cylinder is ended, or may be calculated every time when each crank angle θd is detected.

The cylinder pressure calculation unit 541 stores the gas pressure in cylinder in burning Pcyl_brn to the storage apparatus 91 such as RAM, together with angle information such as corresponding the angle identification number n and the crank angle θd, during a period at least longer than the combustion stroke.

1-2-4-2. Combustion Parameter Calculation Unit 542

The combustion parameter calculation unit 542 calculates a combustion parameter showing the combustion state, based on the gas pressure in cylinder in burning Pcyl_brn. For example, at least one or more of a heat release rate, a mass combustion rate MFB, and an indicated mean effective pressure IMEP are calculated as the combustion parameter. Other kind of combustion parameter may be calculated.

In the present embodiment, using the equation (26), the combustion parameter calculation unit 542 calculates the heat release rate dQ/dθd per unit crank angle at each crank angle of arithmetic object θd_obj.

$$\frac{d(Q)}{d(\theta d)} = \frac{\kappa}{\kappa - 1}\text{Pcyl_brn}\frac{d(\text{Vcyl_}\theta)}{d(\theta\text{d_obj})} + \frac{1}{\kappa - 1}\text{Vcyl_}\theta\frac{d(\text{Pcyl_brn})}{d(\theta\text{d_obj})} \tag{26}$$

Herein, K is a ratio of specific heat. Vcly_θ is a cylinder volume of the combustion cylinder at the crank angle θd_obj of the arithmetic object, and is calculated as explained using the second equation of the equation (7). The combustion parameter calculation unit 542 calculation unit sets sequentially each crank angle θd within the crank angle range of arithmetic object which is set corresponding to the burning period, as the crank angle of arithmetic object θd_obj, and at each set crank angle θd, performs a calculation processing which calculates the heat release rate dQ/dθd. The calculated heat release rate dQ/dθd of each crank angle θd_obj of the arithmetic object is stored to the storage apparatus 91, such as RAM, similar to other calculation values.

Using the equation (27), the combustion parameter calculation unit 542 calculates the mass combustion rate MFB of each crank angle θd_obj of the arithmetic object, by dividing a section integral value obtained by integrating the heat release rate dQ/dθd from the combustion start angle θ0 to the crank angle θd_obj of the arithmetic object, by an all integral value Q0 obtained by integrating the heat release rate dQ/dθd for over the whole combustion angle interval. The combustion parameter calculation unit 542 sets sequentially each crank angle θd within the crank angle range of arithmetic object which is set corresponding to the burning period, as the crank angle of arithmetic object θd_obj, and at each set crank angle θd, performs a calculation processing which calculates the mass combustion rate MFB. The calculated mass combustion rate MFB of each crank angle θd_obj of the arithmetic object is stored to the storage apparatus 91, such as RAM, similar to other calculation values.

$$MFB = \frac{\int_{\theta 0}^{\theta d_obj} \frac{d(Q)}{d(\theta d)} d(\theta d)}{Q0} \tag{27}$$

About each combustion cylinder, using the equation (28), the combustion parameter calculation unit 542 calculates the indicated mean effective pressure IMEP by integrating the gas pressure in cylinder in burning Pcyl_brn with respect to the cylinder volume Vcly_θ of the combustion cylinder.

$$IMEP = \frac{1}{Vcylall}\int_{Vcyls}^{Vcyle} \text{Pcyl_brn}\ d(\text{Vcyl_}\theta) \tag{28}$$

Herein, Vcylall is a stroke volume, Vcyls is a cylinder volume at integral start, and Vclye is a cylinder volume at integral end. The volume interval for integration may be set to a volume interval corresponding to the four cycles, or may be set to a volume interval corresponding to at least the combustion stroke. Vcly_θ is calculated based on the crank angle θd, as shown in the second equation of the equation (7). The combustion parameter calculation unit 542 sequentially sets each crank angle θd as the θd_obj of the arithmetic object; and at each set crank angle θd, performs an integration processing of the gas pressure in cylinder in burning Pcyl_brn.

1-2-5. Combustion Control Unit 55

The combustion control unit 55 performs a combustion control which changes at least one or both of the ignition timing and the EGR amount, based on the combustion parameter. In the present embodiment, the combustion control unit 55 determines a crank angle θd at which the mass combustion rate MFB becomes 0.5 (50%) (referred to as a combustion central angle), and changes at least one or both of the ignition timing and the EGR amount so that the combustion central angle approaches a preliminarily set target angle. For example, when the combustion central angle is on the retard angle side rather than the target angle, the combustion control unit 55 changes the ignition timing to the advance angle side, or decreases the opening degree of the EGR valve 22 so as to decrease the EGR amount. When the EGR amount is decreased, a burning speed becomes fast and the combustion central angle changes to the advance angle side. On the other hand, when the combustion central angle is on the advance angle side rather than the target angle, the combustion control unit 55 changes the ignition timing to the retard angle side, or increases the opening degree of the EGR valve 22 so as to increase the EGR amount.

Alternatively, the combustion control unit 55 may determine a crank angle θd at which the heat release rate dQ/dθd becomes a maximum value, and change at least one or both of the ignition timing and the EGR amount so that this crank angle θd approaches a preliminarily set target angle.

Alternatively, the combustion control unit 55 may changes at least one or both of the ignition timing and the EGR amount so that the indicated mean effective pressure IMEP approaches a target value which is set for every operating condition.

Other control parameters (for example, the opening and closing timing of the intake valve, the opening and closing timing of the exhaust valve) related to the combustion state may be changed.

1-2-6. Unburning Condition Shaft Torque Learning Unit 56

The unburning condition shaft torque learning unit 56 updates the specific unburning condition data by the actual shaft torque in unburning Tcrkd which was calculated at each crank angle θd in the unburning condition of the internal combustion engine and the specific operating condition.

As mentioned above, the specific condition of the intake gas amount in cylinder included in the specific operating condition is set to a condition of the intake gas amount in cylinder whose frequency is higher than a fixed value when the internal combustion engine is unburning condition. And, the specific condition of the intake gas amount in cylinder included in the specific operating condition is set to a condition of the intake gas amount in cylinder in which the fuel cut is performed. In the present embodiment, when it is unburning condition and the current operating condition coincides with one of the specific operating conditions (the specific crank angle speed, the specific condition of the intake gas amount in cylinder) corresponding to the plurality of specific unburning condition data, the unburning condition shaft torque learning unit 56 updates the specific unburning condition data whose operating condition coincided, by the calculated actual shaft torque in unburning Tcrkd.

In the present embodiment, the unburning condition shaft torque learning unit 56 refers to the specific unburning condition data of update object stored in the storage apparatus 91 and reads out the shaft torque in unburning Tcrk_mot_sp corresponding to the crank angle θd of update object; changes the shaft torque in unburning Tcrk_mot_sp of the crank angle θd of update object which is set in the specific unburning condition data stored in the storage apparatus 91, so that the read shaft torque in unburning Tcrk_mot_sp approach the actual shaft torque in unburning Tcrkd calculated at the crank angle θd of update object.

A change amount from the initial specific unburning condition data which is preliminarily set based on experimental data and stored in ROM or EEPROM may be stored in the backup RAM or the like, as a change amount of specific unburning condition data and be updated. Then, a total value of a value read from the preliminarily set initial specific unburning condition data and a value read from the change amount of specific unburning condition data may be used as the final shaft torque in unburning Tcrk_mot.

The change amount of specific unburning condition data is set for each of the plurality of specific crank angle speeds, similar to the initial specific unburning condition data. In the case where the neural network is used for the specific unburning condition data or the change amount of specific unburning condition data, the actual shaft torque in unburning Tcrkd mot and the like are set as teacher data, and the neural network is learned by the back propagation or the like.

A high pass filter processing which attenuates components of period longer than the stroke period may be performed to the actual shaft torque in unburning Tcrkd mot used for updating. By this high pass filter processing, the external load torque Tload included in the actual shaft torque in unburning Tcrkd mot can be reduced, and it can be suppressed that the updated specific unburning condition data is fluctuated by fluctuation of the external load torque Tload.

The unburning condition shaft torque learning unit 56 may update the shaft torque in unburning Tcrk_mot of each crank angle θd which is set in the specific unburning condition data, by a value obtained by performing a statistical processing to the actual shaft torques in unburning Tcrkd mot of plural times which are calculated at each crank angle θd in the combustion strokes of plural times in the specific operating condition of unburning condition. As the statistical processing value, an average value, a median, or the like is used. For example, the shaft torque in unburning Tcrk_mot of each crank angle θd set in the specific unburning condition data is replaced or brought close to the statistical processing value of each crank angle θd.

Alternatively, the unburning condition shaft torque learning unit 56 updates the shaft torque in unburning Tcrk_mot of each crank angle θd which is set in the specific unburning condition data, by a value obtained by performing a low pass filter processing of each crank angle to the actual shaft torque in unburning Tcrkd calculated at each crank angle θd in the specific operating condition of unburning condition. About each crank angle θd, individually, the filter processing is performed and the filter value is calculated. As the low pass filter processing, for example, the finite impulse response (FIR) filter mentioned above, a first order lag filter, or the like is used. The shaft torque in unburning Tcrk_mot of each crank angle θd set in the specific unburning condition data is replaced or brought close to the filter value of each crank angle θd.

<Outline Flowchart of Whole Processing>

Figure 10:
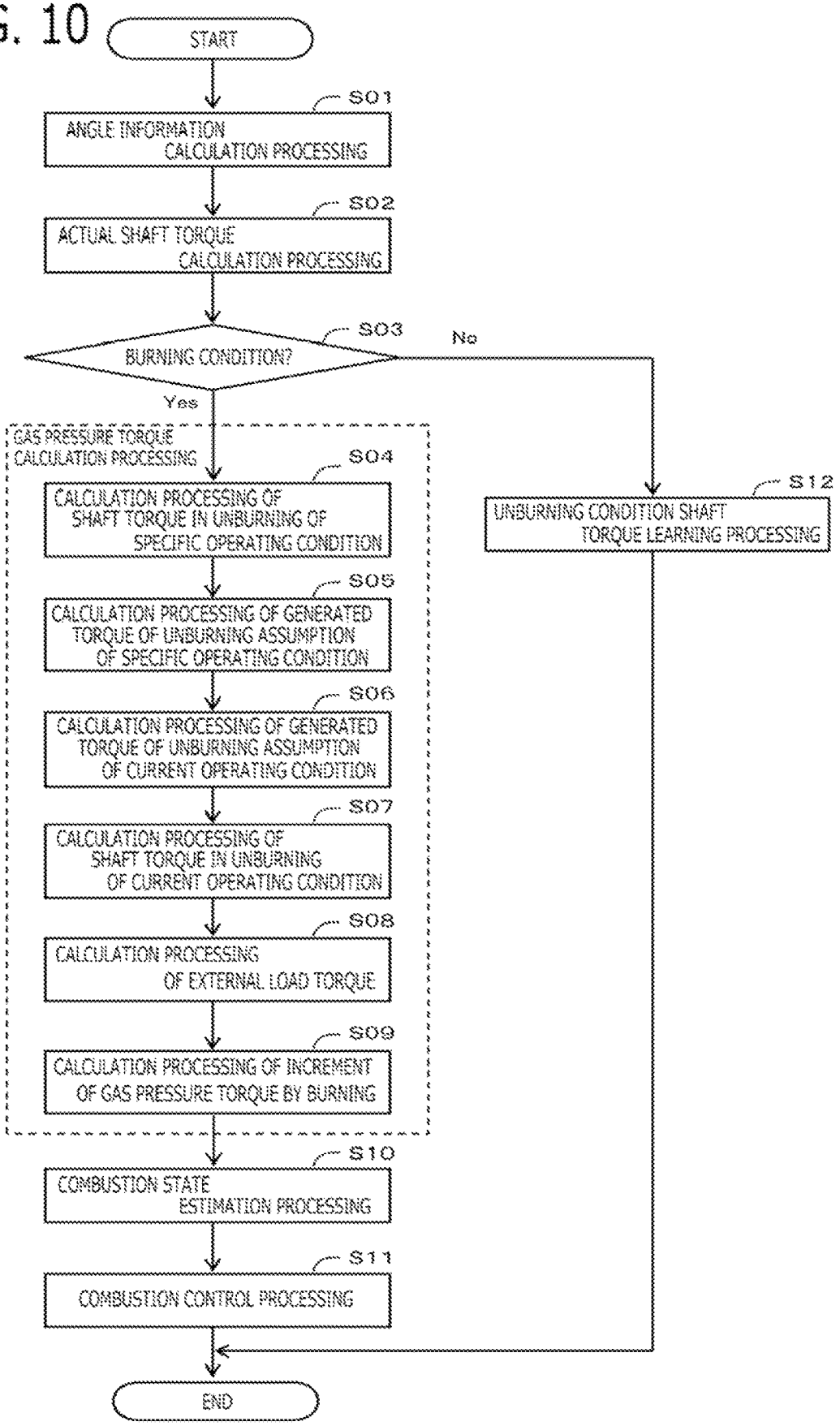
FIG. 10 is a flowchart showing the procedure of schematic processing of the controller according to Embodiment 1.

A procedure of schematic processing of the controller 50 (a control method of internal combustion engine) concerning the present embodiment will be explained based on the flow chart shown in FIG. 10. The processing of the flowchart in FIG. 10 is recurrently executed every time when detecting the crank angle θd or every predetermined operation cycle, by the arithmetic processor 90 executing software (a program) stored in the storage apparatus 91.

In the step S01, as mentioned above, the angle information detection unit 51 performs an angle information detection processing (an angle information detection step) which detects the crank angle θd, crank angle speed ωd, and the crank angle acceleration ad based on the output signal of the second crank angle sensor 6.

In the step S02, as mentioned above, the actual shaft torque calculation unit 52 performs an actual shaft torque calculation processing (an actual shaft torque calculation step) which calculates the actual shaft torque Tcrkd applied to the crankshaft, based on the detection value of the crank angle acceleration ad and the inertia moment Icrk of the crankshaft system.

In the step S03, the controller 50 determines whether it is burning condition of the internal combustion engine or unburning condition of the internal combustion engine. And, when it is burning condition, it advances to the step S04, and when it is unburning condition, it advances to the step S08. Herein, "burning condition" and "in burning" are a condition and a time that the controller 50 controls so as to burn fuel in the combustion stroke. And, "unburning condition" and "in unburning" are a condition and a time that the controller 50 controls so as not to burn fuel in the combustion stroke.

In the step S04, as mentioned above, at the crank angle of arithmetic object θd_obj, by referring to a specific unburning condition data in which a relationship between the crank angle θd and a shaft torque in unburning of the specific operating condition Tcrk_mot_sp is set, the gas pressure torque calculation unit 53 calculates the shaft torque in unburning of the specific operating condition Tcrk_mot_sp corresponding to each crank angle of arithmetic object θd_obj. In the step S05, as mentioned above, at the crank angle of arithmetic object θd_obj, using the physical model equation of the crank mechanism, the gas pressure torque calculation unit 53 calculates the generated torque of unburning assumption of the specific operating condition Tcal_mot_sp which is a torque generated by the gas pressure in cylinder and the reciprocating movement of piston when assuming that it is the specific operating condition and it is unburning.

In the step S06, as mentioned above, at the crank angle of arithmetic object θd_obj, using the physical model equation of the crank mechanism, the gas pressure torque calculation unit 53 calculates the generated torque of unburning assumption of the current operating condition Tcal_mot which is a torque generated by the gas pressure in cylinder and the reciprocating movement of piston when assuming that it is unburning in the current operating condition. In the step S07, as mentioned above, at the crank angle of arithmetic object θd_obj, the gas pressure torque calculation unit 53 calculates the shaft torque in unburning of the current operating condition Tcrk_mot, by correcting the generated torque of unburning assumption of the current operating condition Tcal_mot based on the shaft torque in unburning of the specific operating condition Tcrk_mot_sp and the generated torque of unburning assumption of the specific operating condition Tcal_mot_sp.

In the step S08, as mentioned above, the gas pressure torque calculation unit 53 calculates the external load torque Tload_brn which is a torque applied to the crankshaft from the outside of the internal combustion engine, based on the shaft torque in unburning of the current operating condition Tcrk_mot and the actual shaft torque in burning Tcrkd_brn which were calculated at the crank angle in the vicinity of the top dead center of the combustion stroke. In the step S09, as mentioned above, at the crank angle of arithmetic object θd_obj, the gas pressure torque calculation unit 53 calculates the increment of gas pressure torque by burning ΔTgas_brn which is included in the gas pressure torque generated by the gas pressure in cylinder, based on the shaft torque in unburning of the current operating condition Tcrk_mot, the actual shaft torque in burning Tcrkd_brn, and the external load torque Tload_brn.

The gas pressure torque calculation unit 53 sets sequentially each crank angle θd within the crank angle range of arithmetic object which is set corresponding to the burning period as the crank angle of arithmetic object θd_obj, and at each set crank angle θd, performs a calculation processing which calculates the increment of gas pressure torque by burning ΔTgas_brn. The calculation processing of this increment of gas pressure torque by burning ΔTgas_brn may be sequentially performed at detection of each crank angle θd, or may be performed collectively after the end of the one combustion stroke. The processing from these step S04 to step S09 is referred to as a gas pressure torque calculation processing (a gas pressure torque calculation step).

In the step S10, as mentioned above, the combustion state estimation unit 54 performs a combustion state estimation processing (a combustion state estimation step) which estimates the combustion state of the internal combustion engine, based on the increment of gas pressure torque by burning ΔTgas_brn.

In the step S11, as mentioned above, the combustion control unit 55 performs a combustion control processing (a combustion control step) which changes at least one or both of the ignition timing and the EGR amount, based on the combustion parameter.

On the other hand, when it is unburning condition of the internal combustion engine, in the step S12, as mentioned above, the unburning condition shaft torque learning unit 56 performs an unburning condition shaft torque learning processing (an unburning condition shaft torque learning step) which updates the specific unburning condition data by the actual shaft torque in unburning Tcrkd which was calculated at each crank angle θd in the unburning condition of the internal combustion engine and the specific operating condition.

Other Embodiments

Other embodiments of the present disclosure will be described. Each of the configurations of embodiments to be explained below is not limited to be separately utilized but can be utilized in combination with the configurations of other embodiments as long as no discrepancy occurs.

(1) In the above Embodiment 1, there was explained the case where the crank angle θd, the crank angle speed ωd, and the crank angle acceleration ad are detected based on the output signal of the second crank angle sensor 6. However, based on the output signal of the first crank angle sensor 11, the crank angle θd, the crank angle speed ωd, and the crank angle acceleration ad may be detected.

(2) In the above Embodiment 1, there was explained the case where the 3-cylinder engine whose cylinder number is three is used. However, the engine of any cylinder numbers (for example, 1-cylinder, 2-cylinder, 4-cylinder, 6-cylinder) may be used.

(3) In the above Embodiment 1, there was explained the case where the internal combustion engine 1 is a gasoline engine. However, embodiments of the present disclosure are not limited to the foregoing case. That is to say, the internal combustion engine 1 may be various kinds of internal combustion engines, such as a diesel engine and an engine which performs HCCI combustion (Homogeneous-Charge Compression Ignition Combustion).

(4) In the above Embodiment 1, there was explained the case where the controller 50 calculates the gas pressure in cylinder in burning Pcyl_brn based on the increment of gas pressure torque by burning ΔTgas_brn and the like, calculates the combustion parameter of one or both of the heat release rate and the mass combustion rate MFB based on the gas pressure in cylinder in burning Pcyl_brn, and estimates the combustion state of the internal combustion engine. However, without calculating the gas pressure in cylinder in burning Pcyl_brn and the combustion parameter, the controller 50 may estimate the combustion state based on a behavior of the increment of gas pressure torque by burning ΔTgas_brn (for example, an integration value in the combustion stroke, a peak value in the combustion stroke, the crank angle at the peak value, or the like). Alternatively, without calculating the combustion parameter, the controller 50 may estimate the combustion state based on a behavior of the gas pressure in cylinder in burning Pcyl_brn (for example, an integration value in the combustion stroke, a peak value in the combustion stroke, the crank angle at the peak value, or the like).

(5) In the above Embodiment 1, there was explained the case where the controller 50 calculates the heat release rate and the mass combustion rate based on the gas pressure in cylinder in burning Pcyl_brn, and performs the combustion control. However, the controller 50 may perform other controls, such as a misfire detection of combustion cylinder, based on the increment of gas pressure torque by burning ΔTgas_brn, the gas pressure in cylinder in burning Pcyl_brn, or the heat release rate.

Although the present disclosure is described above in terms of an exemplary embodiment, it should be understood that the various features, aspects and functionality described in the embodiment are not limited in their applicability to the particular embodiment with which they are described, but instead can be applied, alone or in various combinations to the embodiment. It is therefore understood that numerous modifications which have not been exemplified can be devised without departing from the scope of the present disclosure. For example, at least one of the constituent components may be modified, added, or eliminated.

What is claimed is:

1. A controller for internal combustion engine, comprising at least one processor configured to implement:

an angle information detector that detects a crank angle, a crank angle speed, and a crank angle acceleration, based on an output signal of a crank angle sensor;

an actual shaft torque calculator that calculates an actual shaft torque applied to a crankshaft, based on a detection value of the crank angle acceleration, and an inertia moment of a crankshaft system, at each crank angle of an arithmetic object; and a gas pressure torque calculator that, by referring to a specific unburning condition data in which a relationship between a crank angle and a shaft torque in unburning of a specific operating condition is set, calculates the shaft torque in unburning of the specific operating condition corresponding to each crank angle of the arithmetic object;

calculates a generated torque in unburning assumption of the specific operating condition, which is a torque generated by a gas pressure in a cylinder and a reciprocating movement of a piston, assuming the specific operating condition and unburning, using a physical model equation of a crank mechanism, at each crank angle of the arithmetic object;

calculates a generated torque of unburning assumption of a current operating condition which is a torque generated by the gas pressure in the cylinder and the reciprocating movement of the piston assuming unburning in the current operating condition, using the physical model equation of the crank mechanism, at each crank angle of the arithmetic object;

calculates a shaft torque in unburning of the current operating condition, by correcting the generated torque of unburning assumption of the current operating condition based on the shaft torque in unburning of the specific operating condition, and the generated torque of unburning assumption of the specific operating condition, at each crank angle of the arithmetic object;

calculates an external load torque which is a torque applied to the crankshaft from outside of the internal combustion engine, based on the shaft torque in unburning and the actual shaft torque of the current operating condition which were calculated at a crank angle in a vicinity of a top dead center of a combustion stroke; and calculates an increment of gas pressure torque by burning which is included in a gas pressure torque generated by the gas pressure in the cylinder, based on the shaft torque in unburning of the current operating condition, the actual shaft torque in burning, and the external load torque, at each crank angle of the arithmetic object; and a combustion controller that changes at least one or both of an ignition timing and an EGR amount, based on the increment of gas pressure torque by burning.

2. The controller for internal combustion engine according to claim 1, wherein, at each crank angle of the arithmetic object, the gas pressure torque calculator calculates a torque difference, by subtracting the generated torque of unburning assumption of the specific operating condition from the shaft torque in unburning of the specific operating condition, and calculates the shaft torque in unburning of the current operating condition, by adding the torque difference to the generated torque of unburning assumption of the current operating condition.

3. The controller for internal combustion engine according to claim 1, wherein, at each crank angle of the arithmetic object, the gas pressure torque calculator calculates the shaft torque in unburning of the current operating condition, by multiplying a torque ratio of the shaft torque in unburning of the specific operating condition with respect to the generated torque of unburning assumption of the specific operating condition, to the generated torque of unburning assumption of the current operating condition.

4. The controller for internal combustion engine according to claim 2, wherein, at each crank angle of the arithmetic object, the gas pressure torque calculator, using a physical model equation which calculates the gas pressure torque generated by the gas pressure in the cylinder, calculates the gas pressure torque generated by the gas pressure in the cylinder when assuming that the internal combustion engine is unburning condition, based on a specific condition of an intake gas amount in the cylinder included in the specific operating condition; using a physical model equation which calculates an inertia torque generated by the reciprocating movement of the piston, calculates the inertia torque generated by the reciprocating movement of the piston, based on a specific crank angle speed included in the specific operating condition; and calculates the generated torque of unburning assumption of the specific operating condition by totaling the gas pressure torque and the inertia torque, and at each crank angle of the arithmetic object, the gas pressure torque calculator, using the physical model equation which calculates the gas pressure torque, calculates the gas pressure torque generated by the gas pressure in the cylinder when assuming that the internal combustion engine is unburning condition, based on a current condition of the intake gas amount in the cylinder; using the physical model equation which calculates the inertia torque generated by the reciprocating movement of the piston, calculates the inertia torque generated by the reciprocating movement of the piston, based on the detection value of the crank angle speed; and calculates the generated torque of unburning assumption of the current operating condition by totaling the gas pressure torque and the inertia torque.

5. The controller for internal combustion engine according to claim 1, wherein a specific condition of an intake gas amount in the cylinder included in the specific operating condition is set to a condition of the intake gas amount in the cylinder whose frequency is higher than a fixed value when the internal combustion engine is unburning condition.

6. The controller for internal combustion engine according to claim 1, wherein a specific condition of an intake gas amount in the cylinder included in the specific operating condition is set to a condition of the intake gas amount in the cylinder in which a fuel cut is performed.

7. The controller for internal combustion engine according to claim 1, wherein a specific crank angle speed is included in the specific operating condition, the specific unburning condition data is set for each of a plurality of the specific crank angle speeds, and the gas pressure torque calculator, by referring to the specific unburning condition data of the specific crank angle speed closest to the detection value of the crank angle speed, calculates the shaft torque in unburning of the specific operating condition corresponding to each crank angle of the arithmetic object.

8. The controller for internal combustion engine according to claim 1, wherein a specific crank angle speed is included in the specific operating condition, the specific unburning condition data is set for each of a plurality of the specific crank angle speeds, and the gas pressure torque calculator, by referring to the specific unburning condition data of the first specific crank angle speed closest to the detection value of the crank angle speed, calculates the shaft torque in unburning of the first specific operating condition corresponding to each crank angle of the arithmetic object, by referring to the specific unburning condition data of the second specific crank angle speed second closest to the detection value of the crank angle speed, calculates the shaft torque in unburning of the second specific operating condition corresponding to each crank angle of the arithmetic object, and at each crank angle of the arithmetic object, calculates the final shaft torque in unburning of the specific operating condition, by performing linear interpolation between the shaft torque in unburning of the first specific operating condition and the shaft torque in unburning of the second specific operating condition, based on a ratio of a deviation between the detection value of the crank angle speed and the first specific crank angle speed, and a deviation between the detection value of the crank angle speed and the second specific crank angle speed.

9. The controller for internal combustion engine according to claim 1, further comprising an unburning condition shaft torque learning calculator that updates the specific unburning condition data by the actual shaft torque in unburning which was calculated at each crank angle in the unburning condition of the internal combustion engine and the specific operating condition.

10. The controller for internal combustion engine according to claim 9, wherein the unburning condition shaft torque learning calculator updates the shaft torque in unburning of each crank angle which is set in the specific unburning condition data, by a value obtained by performing a statistical processing to the actual shaft torques in unburning of plural times which were calculated at each crank angle in the combustion strokes of plural times in the specific operating condition of unburning condition.

11. The controller for internal combustion engine according to claim 9, wherein the unburning condition shaft torque learning calculator updates the shaft torque in unburning of each crank angle which is set in the specific unburning condition data, by a value obtained by performing a low pass filter processing of each crank angle to the actual shaft torque in unburning calculated at each crank angle in the specific operating condition of unburning condition.

12. The controller for internal combustion engine according to claim 1, further comprising a combustion state estimator that estimates a combustion state of the internal combustion engine, based on the increment of gas pressure torque by burning.

13. The controller for internal combustion engine according to claim 1, further comprising a cylinder pressure calculator, at each crank angle of the arithmetic object, calculates a gas pressure in the cylinder in unburning when assuming that it is unburning, based on a current condition of an intake gas amount in the cylinder, and at each crank angle of the arithmetic object, calculates a gas pressure in the cylinder in burning, based on the gas pressure in the cylinder in unburning and the increment of gas pressure torque by burning.

14. The controller for internal combustion engine according to claim 13, further comprising:

a combustion parameter calculator that calculates a combustion parameter showing a combustion state, based on the gas pressure in the cylinder in burning, and a combustion controller that changes at least one or both of an ignition timing and an EGR amount, based on the combustion parameter.

15. The controller for internal combustion engine according to claim 1, wherein each crank angle of the arithmetic object is set to each crank angle within a crank angle range of the arithmetic object which is set corresponding to a burning period.

16. A control method for an internal combustion engine, comprising:

an angle information detecting that detects a crank angle, a crank angle speed, and a crank angle acceleration, based on an output signal of a crank angle sensor;

an actual shaft torque calculating that calculates an actual shaft torque applied to a crankshaft, based on a detection value of the crank angle acceleration, and an inertia moment of a crankshaft system, at each crank angle of an arithmetic object; and a gas pressure torque calculating that, by referring to specific unburning condition data in which a relationship between a crank angle and a shaft torque in unburning of a specific operating condition is set, calculates the shaft torque in unburning of the specific operating condition corresponding to each crank angle of the arithmetic object;

calculates a generated torque in unburning assumption of the specific operating condition which is a torque generated by a gas pressure in a cylinder and a reciprocating movement of a piston, assuming the specific operating condition and it is unburning, using a physical model equation of a crank mechanism, at each crank angle of the arithmetic object;

calculates a generated torque of unburning assumption of a current operating condition which is a torque generated by the gas pressure in the cylinder and the reciprocating movement of the piston assuming unburning in a current operating condition, using the physical model equation of the crank mechanism, at each crank angle of the arithmetic object;

calculates a shaft torque in unburning of the current operating condition, by correcting the generated torque of unburning assumption of the current operating condition based on the shaft torque in unburning of the specific operating condition, and the generated torque of unburning assumption of the specific operating condition, at each crank angle of the arithmetic object;

calculates an external load torque which is a torque applied to the crankshaft from an outside of the internal combustion engine, based on the shaft torque in unburning and the actual shaft torque of the current operating condition which were calculated at a crank angle in a vicinity of a top dead center of a combustion stroke;

calculates an increment of gas pressure torque by burning which is included in a gas pressure torque generated by the gas pressure in the cylinder, based on the shaft torque in unburning of the current operating condition, the actual shaft torque in burning, and the external load torque, at each crank angle of the arithmetic object; and changing at least one or both of an ignition timing and an exhaust gas recirculation (EGR) amount, based on the increment of gas pressure torque by burning.

* * * * *